US008422727B2

(12) United States Patent
Takewa

(10) Patent No.: US 8,422,727 B2
(45) Date of Patent: Apr. 16, 2013

(54) ELECTRO-ACOUSTICAL TRANSDUCER

(75) Inventor: Hiroyuki Takewa, Osaka (JP)

(73) Assignee: Panasonic Corporation, Osaka (JP)

( * ) Notice: Subject to any disclaimer, the term of this patent is extended or adjusted under 35 U.S.C. 154(b) by 944 days.

(21) Appl. No.: 12/181,073

(22) Filed: Jul. 28, 2008

(65) Prior Publication Data

US 2009/0034751 A1 Feb. 5, 2009

(30) Foreign Application Priority Data

Jul. 30, 2007 (JP) ..... 2007-198087

(51) Int. Cl.
*H04R 1/00* (2006.01)
*H04R 9/06* (2006.01)
*H04R 11/02* (2006.01)

(52) U.S. Cl.
USPC ..... 381/422; 381/398; 381/403

(58) Field of Classification Search ..... 381/401, 381/403, 407, 408, 412, 419–422
See application file for complete search history.

(56) References Cited

U.S. PATENT DOCUMENTS

| | | | | |
|---|---|---|---|---|
| 4,281,223 | A * | 7/1981 | Ugaji et al. | 381/408 |
| 4,354,066 | A * | 10/1982 | Necoechea | 381/408 |
| 4,899,390 | A * | 2/1990 | Takewa et al. | 381/349 |
| 6,956,953 | B2 * | 10/2005 | Mazarakis | 381/152 |
| 2004/0022408 | A1 * | 2/2004 | Mango et al. | 381/408 |
| 2004/0136558 | A1 * | 7/2004 | Usuki et al. | 381/394 |
| 2007/0165902 | A1 * | 7/2007 | Matsumura et al. | 381/396 |
| 2008/0063235 | A1 | 3/2008 | Takewa | |
| 2008/0101649 | A1 * | 5/2008 | Kosuda et al. | 381/412 |

FOREIGN PATENT DOCUMENTS

| | | |
|---|---|---|
| JP | 2001-211497 | 8/2001 |
| JP | 2004-531919 | 10/2004 |
| JP | 2004-364247 | 12/2004 |
| JP | 2007-104626 | 4/2007 |
| JP | 2008-118218 | 5/2008 |
| WO | 02/059879 | 8/2002 |
| WO | 2005/117489 | 12/2005 |

* cited by examiner

*Primary Examiner* — Charles Garber
*Assistant Examiner* — Calvin Choi
(74) *Attorney, Agent, or Firm* — Wenderoth, Lind & Ponack, L.L.P.

(57) ABSTRACT

An electro-acoustical transducer of the present invention includes: a diaphragm of an elongated shape; a first magnet of a parallelepiped shape which is situated at a side of one principal surface of the diaphragm such that long sides thereof are in parallel with long sides of the diaphragm, and which is polarized in a short side direction to form a magnetic gap; a second magnet of a parallelepiped shape which is situated next to the first magnet in the short side direction of the diaphragm, such that long sides thereof are in parallel with the long sides of the diaphragm, and which is polarized toward a direction in a manner opposite to the first magnet so as to form a magnetic gap; and a coil of an elongated ring shape which is situated on the diaphragm such that long sides thereof are situated in the magnetic gaps.

12 Claims, 36 Drawing Sheets

ELECTRO-ACOUSTICAL TRANSDUCER

BACKGROUND OF THE INVENTION

1. Field of the Invention

The present invention relates to an electro-acoustical transducer, and more particularly relates to an electro-acoustical transducer which is capable of realizing a sound reproduction in an ultra-high frequency band.

2. Description of the Background Art

Recently, as a medium such as a DVD and a DVD-AUDIO has become widespread, an electro-acoustical transducer which is capable of reproducing a high frequency band so as to reproduce an ultra-high frequency band sound included in a content of the medium has been desired. In order to realize the reproduction of the ultra-high band sound, electro-acoustical transducers as shown in FIGS. 22A, 22B, 23A, 23B, and 23C have been proposed (e.g., Japanese Laid-Open Patent Publication No. 2001-211497 and the like). FIGS. 22A and 22B are diagrams each showing an exemplary structure of a conventional electro-acoustical transducer. FIG. 22A is a front view, and FIG. 22B is a cross sectional view of the electro-acoustical transducer as cut along a center line AA in a short side direction thereof shown in FIG. 22A. FIGS. 23A, 23B, and 23C are diagrams each showing another exemplary structure of the conventional electro-acoustical transducer. FIG. 23A is a front view of an electro-acoustical transducer. FIG. 23B is a cross sectional view of the electro-acoustical transducer as cut along a center line AA in a long side direction thereof shown in FIG. 23A. FIG. 23C is a cross sectional view of the electro-acoustical transducer as cut along a center line BB in a short side direction thereof shown in FIG. 23A.

As shown in each of FIGS. 22A and 22B, the electro-acoustical transducer includes a yoke 901, a magnet 902, a diaphragm 903, a spacer 904 and coils 905. The yoke 901 is of a concave shape, and is made from a ferromagnetic material such as iron. The magnet 902 is a planar neodymium magnet which is polarized in a thickness direction thereof. The magnet 902 is firmly fixed on an inner bottom surface of the concave portion of the yoke 901, and between the magnet 902 and the yoke 901, magnetic gaps G1 and G2 are formed. A top surface of the magnet 902 and a top surface of the yoke 901 are situated on a common plane, and on the top surfaces thereof, the diaphragm 903 in a film form is firmly fixed via the spacer 904. The coil 905 is patterned on the diaphragm 903 so as to be situated within ranges of the magnetic gaps G1 and G2. At a central part of the magnet 902, a magnetic flux is emitted from the magnet 902 toward a direction substantially perpendicular to a top surface of the magnet 902, on the other hand, at a peripheral portion of the magnet 902, the magnetic flux is emitted toward a direction diagonally to the top surface thereof. The magnetic fluxes then pass through the coil 905. In such static magnetic field, when an electric current flows to the coil 905, a drive force is generated in a direction perpendicular to the diaphragm 903 (an up-down direction in FIG. 22B), and the generated drive force causes the diaphragm 903 to vibrate in the up-down direction, whereby a sound is generated. The drive force is proportional to the magnetic flux, among the magnetic fluxes passing through the coil 905, which is perpendicular to the vibration direction of the diaphragm 903.

In the electro-acoustical transducer, as shown in FIGS. 22A and 22B, a vibrating portion, on which the coil 905 is patterned, is of an elongated shape. Therefore, a resonant frequency of a resonant mode generated in the short side direction of the vibrating portion is high, and a peak/dip is hardly caused by the resonant mode in an ultra-high frequency band. In this manner, in the case of the electro-acoustical transducer shown in FIGS. 22A and 22B, the vibrating portion is formed in the elongated shape, whereby a fluctuation in a sound-pressure frequency characteristic in the ultra-high band, which is caused by the resonant mode, is reduced.

As shown in FIGS. 23A, 23B and 23C, the electro-acoustical transducer includes a frame 906, a yoke 907, a magnet 908, a diaphragm 909, a coil 910 and an edge 911. The frame 906 is of a concave shape. The yoke 907 is of a concave shape and is made from a ferromagnetic material such as iron. The yoke 907 is firmly fixed on an inner bottom surface of the concave portion of the frame 906. On the inner bottom surface of the concave portion of the yoke 907, a magnet 908 of a parallelepiped shape is firmly fixed. The magnet 908 is, for example, a neodymium magnet having an energy product of 44 MGOe, and is polarized in a vibration direction of the diaphragm 909 (an up-down direction in FIG. 23C) As shown in FIG. 23C, due to a structure configured with the yoke 907 and the magnet 908, magnetic gaps G1 and G2 are formed by magnetic fluxes $\phi$ at the side of the diaphragm 909. Bold arrows shown in FIG. 23C indicate the magnetic fluxes $\phi$. The diaphragm 909 is of an elongated track shape (hereinafter referred to as elongated track shape), and is situated above the magnet 908. The coil 910 is formed in an elongated ring shape by winding a copper or an aluminum wire several turns, and is bonded on a top surface of the diaphragm 909 with an adhesive agent Ad. Respective long sides of the coil 910 are situated in the magnetic gaps G1 and G2. Specifically, the respective long sides of the coil 910 are situated such that the centers of widths of the long sides of the coil having been wound are located immediately above extremities T1 and T2 of the magnet 908 in the short side direction. Long sides of the magnet 908 and the coil 910 are in parallel with long sides of the diaphragm 909. The edge 911 is of a semicircle shape as viewed in cross section, and an inner-circumference thereof is firmly fixed to an outer-circumference of the diaphragm 909, and an outer-circumference thereof is firmly fixed on a top surface of the frame 906. Accordingly, the diaphragm 909 is supported by the edge 911 such that the diaphragm 909 vibrates in the up-down direction. In the static magnetic field shown in FIG. 23C, when an electric current flows through the coil 910, the drive force is generated in a direction perpendicular to the diaphragm 909 (in the up-down direction in FIG. 23C), and the generated drive force causes the diaphragm 909 to vibrate in the up-down direction, whereby a sound is generated. The drive force is proportional to the magnetic flux, among the magnetic fluxes $\phi$ passing through the coil 910, which is perpendicular to the vibration direction of the diaphragm 909.

In the electro-acoustical transducer shown in FIGS. 23A, 23B and 23C, the diaphragm 909 is of the elongated shape as shown in FIG. 23A. Accordingly, as with the electro-acoustical transducer shown in FIGS. 22A and 22B, the resonant frequency of the resonant mode generated in the short side direction of the diaphragm 909 is high, and a peak/dip is hardly caused by the resonant mode in the ultra-high frequency band. In this manner, in the case of the electro-acoustical transducer shown in FIGS. 23A, 23B and 23C, the diaphragm 909 is of the elongated shape, whereby the fluctuation in the sound-pressure frequency characteristic in the ultra-high band, which is caused by the resonant mode, is reduced.

In order to realize a sound reproduction in the ultra-high band in a further improved manner, not only the fluctuation in the sound-pressure frequency characteristic caused by the resonance needs to be reduced, but also a reproduced sound pressure level needs to be improved. In order to improve the reproduced sound pressure level, the drive force generated in the coil needs to be increased, and specifically, the magnetic flux in the direction perpendicular to the vibration direction of the diaphragm needs to be increased. In order to increase the magnetic flux in the direction perpendicular to the vibration direction of the diaphragm, a width of the magnet 902 in the short side direction needs to be increased in the case of the electro-acoustical transducer shown in FIGS. 22A and 22B. In FIG. 22B, the width of the magnet 902 needs to be increased in a left-right direction. In the case of the electro-acoustical transducer shown in FIGS. 23A, 23B and 23C, the width in the short side direction of the magnet 908 needs to be increased. In FIG. 23C, the width of the magnet 908 needs to be increased in the left-right direction.

However, in each of the conventional electro-acoustical transducers shown in FIGS. 22A, 22B, 23A, 23B and 23C, even if the width of the magnet 902 or the magnet 908 is increased, the magnetic flux cannot be efficiently increased in the direction perpendicular to the vibration direction of the diaphragm. Hereinafter, a reason why the magnetic flux cannot be efficiently increased will be exemplified by using the conventional electro-acoustical transducer shown in FIGS. 23A, 23B and 23C.

In the electro-acoustical transducer shown in FIGS. 23A, 23B and 23C, when the width in the short side direction of the magnet 908 is increased, the electro-acoustical transducer will be as shown in FIG. 24. FIG. 24 is a cross sectional view of the electro-acoustical transducer shown in FIGS. 23A, 23B and 23C in the case where the width in the short side direction of the magnet 908 is increased. In FIG. 24, without changing the width in the short side direction of the diaphragm 909, the magnet 908 shown in FIG. 23C is replaced with a magnet 908*a*, whose width is wider than the magnet 908, and extremities of the magnet 908*a* in the short side direction are denoted by T3 and T4. The width in the short side of the diaphragm 909 is not changed so as not to cause the sound-pressure frequency characteristic to fluctuate in the ultra-high frequency band. Further, the frame 906 shown in FIG. 23C is replaced with a frame 906*a*, and the yoke 907 shown in FIG. 23C is replaced with a yoke 907*a* so as to be adapted to the magnet 908*a*

A magnetic flux densities in accordance with a coil position are compared between a case where the magnet 908 shown in FIG. 23C is used and a case where the magnet 908*a* shown in FIG. 24. A result of the comparison is shown in FIG. 25. As shown in FIG. 25, a vertical axis indicates the magnetic flux density. The magnetic flux density represents a density of the magnetic flux in the direction perpendicular to the vibration direction of the diaphragm 909. The higher the magnetic flux density is, the more the magnetic flux is increased in the direction perpendicular to the vibration direction of the diaphragm 909. A horizontal axis indicates a distance from a central axis O in the short side direction of the diaphragm 909, and a right side of the horizontal axis, that is, the right side of each of FIGS. 23C and 24 indicates a positive direction. In FIG. 25, a graph (a) shows a distribution of the magnetic flux densities in the case where the magnet 908 shown in FIG. 23C is used, whereas a graph (b) shows the distribution of the magnetic flux densities in the case where the magnet 908*a* shown in FIG. 24 is used.

The graph (a) has a maximum magnetic flux density at a position of each of the extremities T1 and T2. As shown in FIG. 23C, the centers of the widths of the long sides of the coil 910 are located immediately above the extremities T1 and T2, respectively. On the other hand, the graph (b) has a maximum magnetic flux density at a position of each of the extremities T3 and T4. In FIG. 24, in order not to cause the sound-pressure frequency characteristic to fluctuate in the ultra-high frequency band, the width of the diaphragm 909 in the short side direction is not changed. That is, the long sides of the coil 910 shown in FIG. 24 are located at the same positions as the long sides thereof shown in FIG. 23C, respectively, and thus are situated immediately above the positions of the extremities T1 and T2. Therefore, in the graph (b), the magnetic flux density at a position where the coil 910 shown in FIG. 24 is situated is increased only by δB compared to the magnetic flux density at the same position in the graph (a).

In this manner, in the conventional electro-acoustical transducers shown in FIGS. 22A, 22B, 23A, 23B and 23C, even if the widths of the magnets 902 and 907 are increased, the magnetic fluxes in the direction perpendicular to the vibration direction of the diaphragm cannot be increased efficiently. Accordingly, it is difficult, in the conventional electro-acoustical transducers shown in FIGS. 22A, 22B, 23A, 23B and 23C, to realize the sound reproduction in the ultra-high frequency band efficiently.

SUMMARY OF THE INVENTION

Therefore, an object of the present invention is to efficiently improve a reproduced sound pressure level in an ultra-high frequency band, and to provide an electro-acoustical transducer which is capable of realizing an improved reproduction of an ultra-high frequency band sound.

The electro-acoustical transducer according to the present invention is directed to solve the above-described problem. The electro-acoustical transducer according to the present invention includes: a diaphragm of an elongated shape; an edge for supporting the diaphragm such that the diaphragm is vibratable; a first magnet of a parallelepiped shape which is situated at a face of one principal surface of the diaphragm such that long sides thereof are in parallel with long sides of the diaphragm, and which is polarized in a short side direction of the diaphragm to form a magnetic gap to the side of the one principal surface of the diaphragm; a second magnet of a parallelepiped shape which is situated next to the first magnet having an air gap sandwiched therebetween in the short side direction of the diaphragm, such that long sides thereof are in parallel with the long sides of the diaphragm, and which is polarized toward a direction in a manner opposite to the first magnet so as to form a magnetic gap to the side of the one principal surface of the diaphragm; and a first coil which is wound to form an elongated ring shape, and which is situated on the diaphragm such that long sides thereof are in parallel with the long sides of the diaphragm and such that each of the long sides of the first coil is situated within a range of each of the magnetic gaps.

In the electro-acoustical transducer according to the present invention, in order to improve the reproduced sound pressure level by increasing a magnetic flux which is perpendicular to a vibration direction of the diaphragm, widths of the first magnet and the second magnet in the vibration direction of the diaphragm are increased. Further, when the width of the first magnet and the second magnet in the vibration direction of the diaphragm is increased, a position where the magnetic flux density indicates a maximum value does not vary unlike the conventional electro-acoustical transducer. Accordingly, in the electro-acoustical transducer according to the present invention, it is possible to efficiently increase the magnetic flux perpendicular to the vibration direction of the diaphragm while a fluctuation in the sound-pressure frequency characteristic in an ultra-high frequency band is reduced. Therefore, it is possible to improve the reproduced sound pressure level. As a result, an improved sound reproduction in the ultra-high frequency band can be realized.

Preferably, the electro-acoustical transducer according to the present invention further includes a first plate which fills the air gap and which is made from a ferromagnetic material. Further, surfaces of the first magnet, the second magnet and the first plate, the surfaces facing the diaphragm, may be located on a common plane. The electro-acoustical transducer according to the present invention further includes: a second plate situated so as to be in contact with a pole face of the first magnet, the pole face being opposite to the other pole face thereof which is in contact with the first plate; and a third plate situated so as to be in contact with a pole face of the second magnet, the pole face being opposite to the other pole face thereof which is in contact with the first plate. The respective surfaces of the second plate and the third plate, which face the diaphragm, may be located on a plane closer to the diaphragm than the respective surfaces of the first magnet, the second magnet and the first plate. A cross section of the edge may be convex toward the other principal surface of the diaphragm. The second plate and the third plate may be respectively situated such that the respective surfaces thereof, which face the diaphragm, also face the edge. Each of the long sides of the first coil may be situated above at least one of the surfaces of the first magnet, the second magnet, and the first to third plates, the surfaces facing the diaphragm.

Preferably, the electro-acoustical transducer according to the present invention further includes a third magnet of a parallelepiped shape which is situated at a face of the other principal surface of the diaphragm such that long sides thereof are in parallel with the long sides of the diaphragm, and so as to be located above a position between the first magnet and the second magnet in the short side direction of the diaphragm. The third magnet may be polarized in the vibration direction of the diaphragm such that a polarity of a pole face of the third magnet facing the other principal surface of the diaphragm is the same as a polarity of each of the pole faces of the first magnet and the second magnet, the pole faces being in contact with the air gap.

Preferably, a length of the diaphragm in the short side direction may be one-half or less than a length thereof in a long side direction.

Preferably, a length of the first coil in the long side direction may be 60% or more of a length of the diaphragm in the long side direction.

Preferably, the diaphragm and the first coil may be molded in a unified manner.

Preferably, the first coil may be situated such that respective central positions of winding widths of the long sides thereof correspond to respective central positions of widths of the first magnet and the second magnet in the short side direction of the diaphragm.

Preferably, the long sides of the first coil may be situated at positions of nodal lines of a first resonant mode occurring on the diaphragm in the short side direction.

Preferably, the electro-acoustical transducer according to the present invention further includes a second coil which is wound to form an elongated ring shape, and which is situated at an inner side of the first coil on the diaphragm such that long sides thereof are in parallel with the long sides of the diaphragm and such that each of the long sides thereof are located within the range of each of the magnetic gaps. The long sides of the first coil and the second coil may be situated at positions to suppress the first resonant mode and a second resonant mode occurring on the diaphragm in the short side direction.

Alternatively, the electro-acoustical transducer according to the present invention includes: a diaphragm of an elongated shape; a coil provided at a side of one principal surface of the diaphragm; and a magnet provided at a side of the other principal surface of the diaphragm. The coil is situated on the one principal surface, within a range between extremities of the magnet in the short side direction of the diaphragm. The magnet is polarized in the short side direction of the diaphragm.

The present invention is directed to a portable terminal apparatus. The portable terminal apparatus according to the present invention includes the above-described electro-acoustical transducer and an equipment housing accommodating the electro-acoustical transducer.

The present invention is directed to a vehicle. The vehicle according to the present invention includes the above-described electro-acoustical transducer and a vehicle body accommodating the electro-acoustical transducer.

The present invention is directed to an audio-visual apparatus. The audio-visual apparatus according to the present invention includes the above-described electro-acoustical transducer and an equipment housing accommodating the electro-acoustical transducer.

These and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1A:
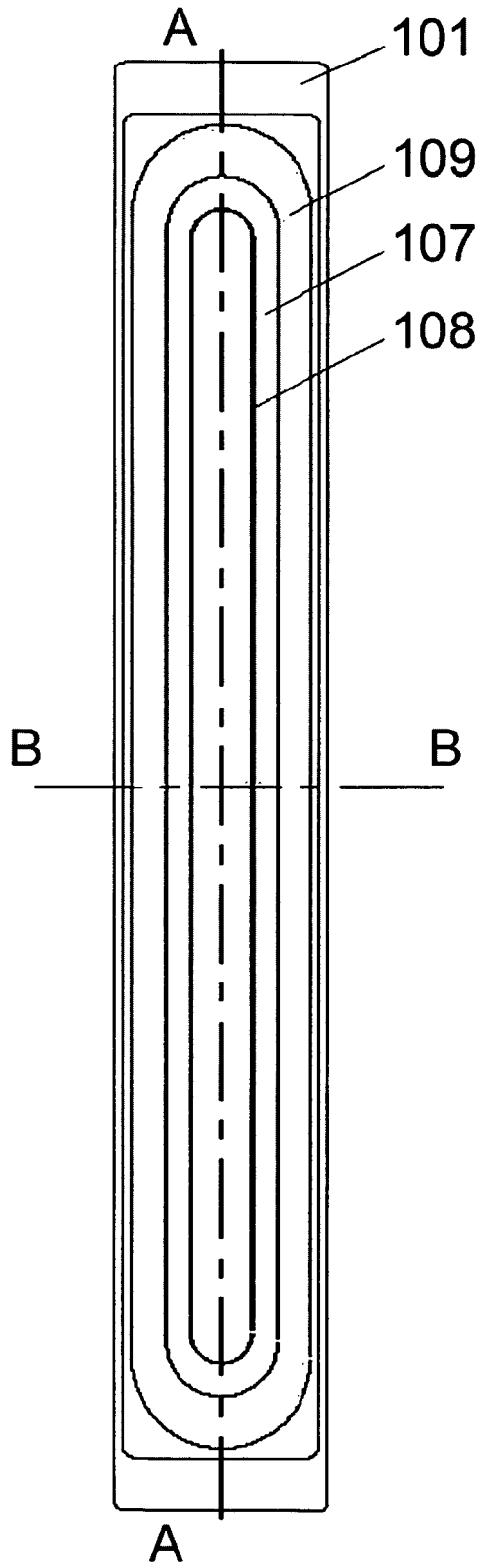
FIG. 1A is a front view of an electro-acoustical transducer according to a first embodiment.
Figure 1B:
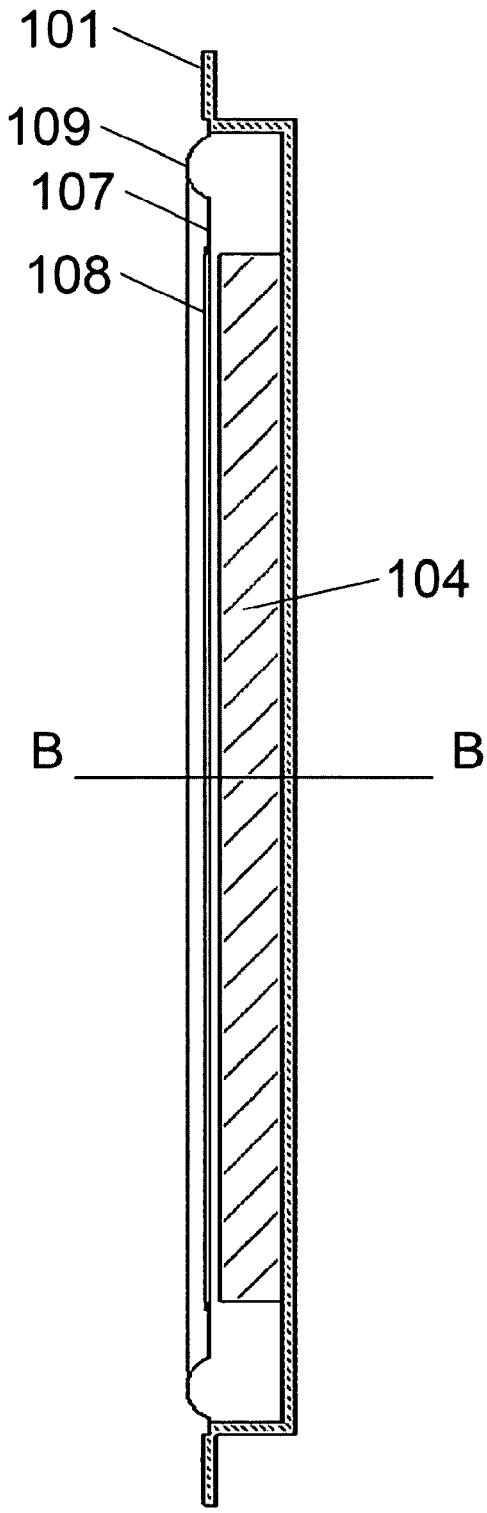
FIG. 1B is a cross sectional view of the electro-acoustical transducer as cut along a center line AA in a long side direction shown in FIG. 1A.
Figure 1C:
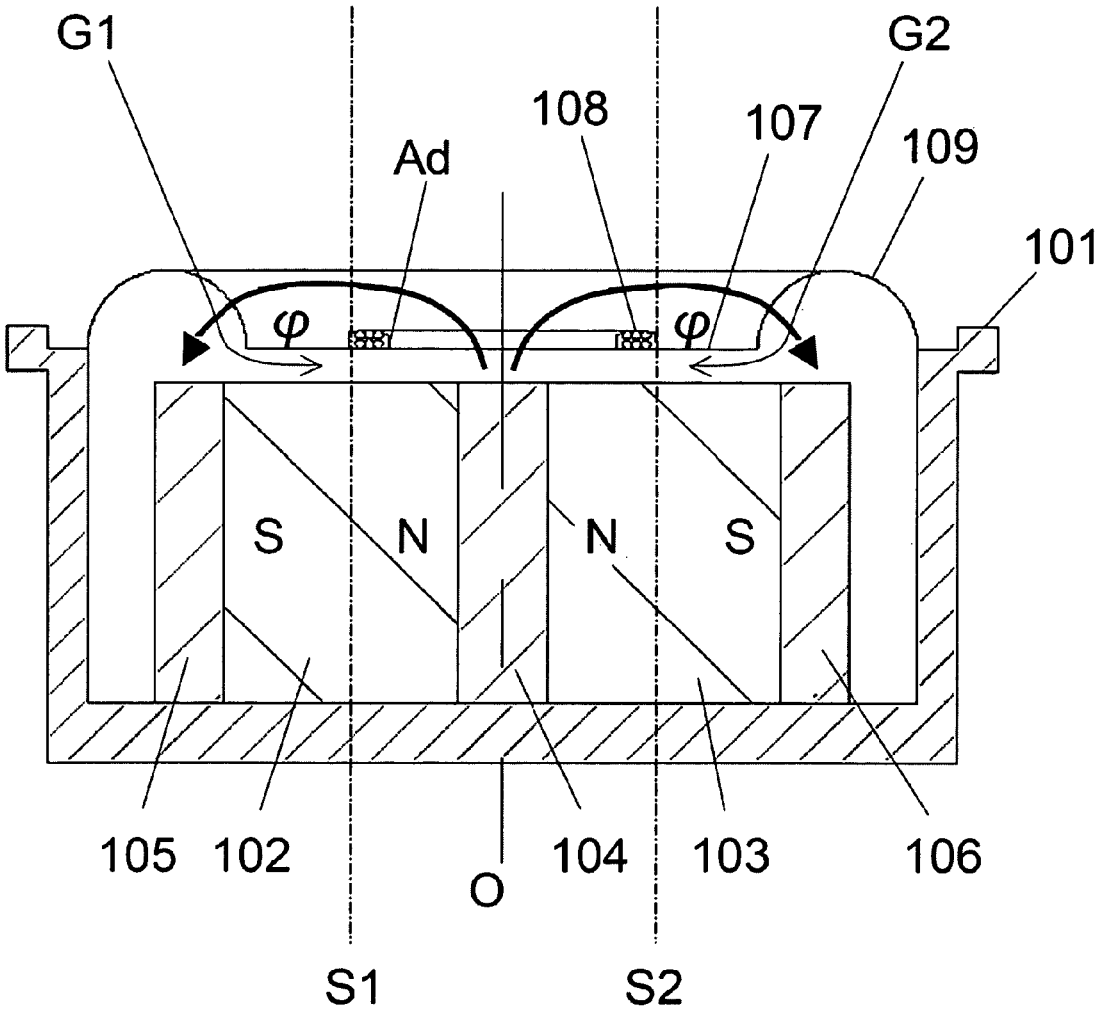
FIG. 1C is a cross sectional view of the electro-acoustical transducer as cut along a center line BB in a short side direction shown in FIG. 1A.

Hereinafter, with reference to FIGS. 1A, 1B and 1C, a structure of an electro-acoustical transducer according to the first embodiment of the present invention will be described. FIGS. 1A, 1B, 1C are diagrams each showing an example of the electro-acoustical transducer according to the first embodiment. FIG. 1A is a front view of the electro-acoustical transducer. FIG. 1B is a cross sectional view of the electro-acoustical transducer as cut along a center line AA in a long side direction shown in FIG. 1A. FIG. 1C is a cross sectional view of the electro-acoustical transducer as cut along a center line BB in a short side direction shown in FIG. 1A.

As shown in each of FIGS. 1A, 1B and 1C, the electro-acoustical transducer according to the first embodiment includes a frame 101, magnets 102 and 103, plates 104 to 106, a diaphragm 107, a coil 108, and an edge 109. The frame 101 is made from a non-magnetic material and is of a concave shape. The diaphragm 107 is of an elongated track shape, and is situated above the magnets 102 and 103 such that an air gap is formed between the diaphragm 107 and the magnets 102 and 103. A central axis O shown in FIG. 1C represents a central axis of the diaphragm 107 in the short side direction.

Each of the magnets 102 and 103 is of a parallelepiped shape, and is, for example, a neodymium magnet having an energy product of 44 MGOe. The magnets 102 and 103 are each situated such that long sides thereof are in parallel with long sides of the diaphragm 107, and is firmly fixed on an inner bottom surface of the concave portion of the frame 101. S1 shown in FIG. 1C represents a central axis of a width of the magnet 102 in the short side direction (hereinafter referred to as a "width central axis S1"), and S2 represents a central axis of a width of the magnet 103 in the short side direction (hereinafter referred to as a "width central axis S2"). The magnet 102 is polarized in the short side direction (in a left-right direction shown in FIG. 1C) of the diaphragm 107. In FIG. 1C, the magnet 102 is polarized from the right side such that a north pole face is formed on the right side, whereas a south pole face is formed on the left side. On the other hand, the magnet 103 is polarized from a side opposite to the magnet 102. That is, in FIG. 1C, the magnet 103 is polarized from the left side such that the north pole face is formed on the left side, whereas the south pole face is formed on the right side. In FIG. 1C, the magnet 102 may be polarized from the left side, and the magnet 103 may be polarized from the right side.

Each of the plates 104 to 106 is of a planar shape, and is made from a ferromagnetic material such as iron. The plate 104 is situated between the magnets 102 and 103. The center of a width of the plate 104 in the short side direction of the diaphragm 107 is situated on the central axis O. The plate 105 is situated so as to be in contact with a pole face of the magnet 102, the pole face being opposite to a pole face which is in contact with the plate 104. The place 106 is situated so as to be in contact with a pole face of the magnet 103, the pole face being opposite to a pole face which is in contact with the plate 104. A top surface of each of the plates 104 to 106 and a top surface of each of the magnets 102 and 103 are located at a common height, that is, on a common plane.

As shown in FIG. 1C, due to a structure configured with the magnets 102 and 103 and plates 104 to 106, magnetic gaps G1 and G2 are formed by magnetic fluxes $\phi$ to the side of the diaphragm 107 from the magnets 102 and 103. The magnets 102 and 103, and the plates 104 to 106 form magnetic circuits, and the magnetic circuits form the magnetic gaps G1 and the G2. Bold arrows shown in FIG. 1C represents the magnetic fluxes $\phi$. The magnetic fluxes $\phi$ will be described later in detail.

The coil 108 is formed in an elongated ring shape by winding a copper wire or an aluminum wire several turns. The coil 108 is situated such that long sides thereof are in parallel with the long sides of the diaphragm 107, and is bonded on a top surface of the diaphragm 107 with an adhesive agent Ad. The coil 108 is of a shape similar to the diaphragm 107. That is, the coil is formed in an elongated track shape. In FIG. 1C, the respective long sides of the coil 108 are situated in the vicinity of the width central axes S1 and S2. The respective long sides of the coil 108 may be at least situated with in the ranges of the magnetic gaps G1 and G2. Therefore, the respective long sides of the coil 108 may be situated above a range between the plates 105 and 106, respectively. That is, each of the long sides of the coil 108 may be situated so as to face any one of the top surfaces of the magnets 102 and 103 and plates 104 to 106. More preferably, the respective long sides of the coil 108 may be situated such that centers of the widths thereof are situated on the central axes S1 and S2, respectively.

The respective long sides of the coil 108 are situated in the vicinity of nodal lines of a first resonant mode occurring on the diaphragm 107 in the short side direction. In FIG. 1C, suppose a length of the short side of the diaphragm 107 is 1, and a left extremity of the diaphragm 107 measures 0, and a right extremity of the same measures 1. In this case, one of the long sides of the coil 108 is situated at a position of 0.224, and the other long side is situated at a position of 0.776. More preferably, each of the long sides of the coil 108 is situated such that the center of the width thereof corresponds a position of each of the nodal lines of the first resonant mode occurring on the diaphragm 107 in the short side direction. Further, a length the coil 108 in the long side direction is equal to or more than 60% of a length of the diaphragm 107 in the long side direction.

The edge 109 is of an upper semicircle shape as viewed in cross section. An inner-circumference thereof is firmly fixed to an outer-circumference of the diaphragm 107, and an outer-circumference thereof is firmly fixed on the top surface of the frame 101. Accordingly, the diaphragm 107 is supported by the edge 109 such that the diaphragm 107 vibrates in an up-down direction.

Figure 2:
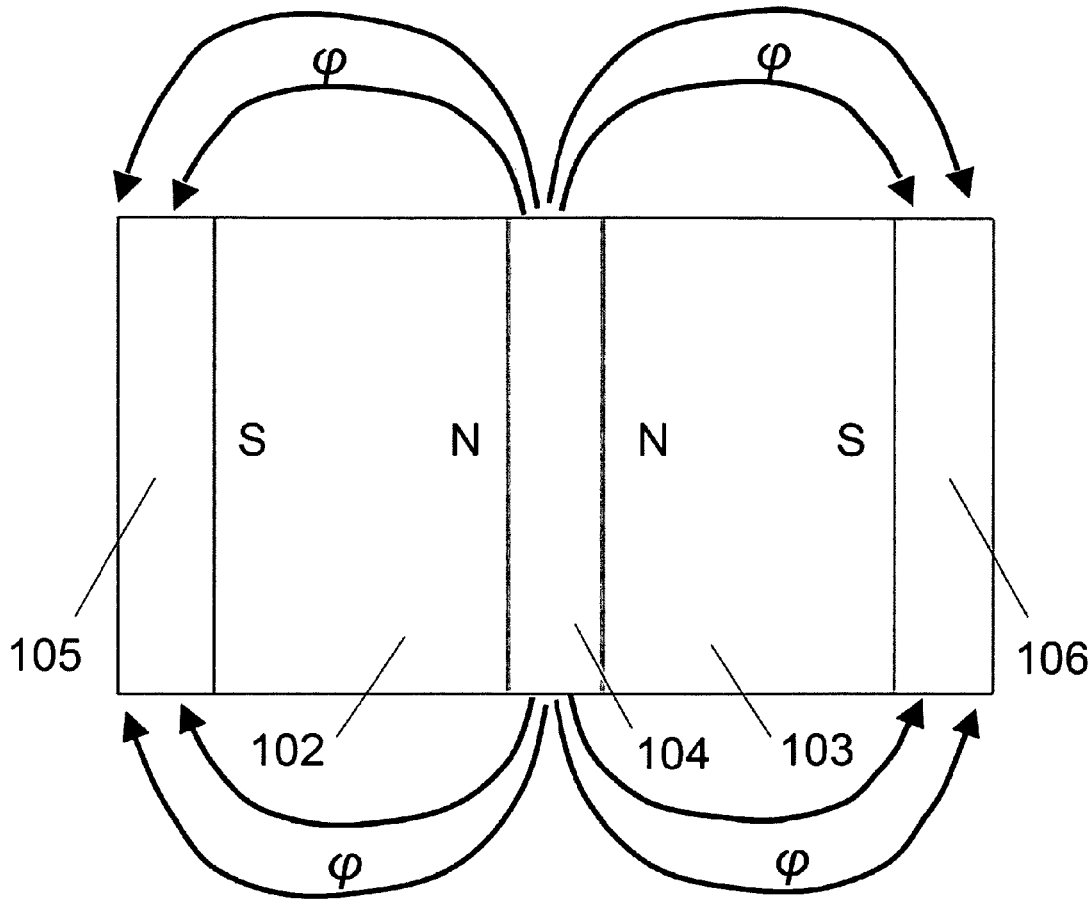
FIG. 2 is a diagram showing, in detail, flows of magnetic fluxes $\phi$.

Next, an operation of the electro-acoustical transducer according to the first embodiment will be described. When an alternative current is not supplied to the coil 108, the magnetic fluxes ϕ, as shown in FIG. 2, are formed by the magnets 102 and 103 and plates 104 to 106. FIG. 2 is a diagram showing, in detail, flows of the magnetic fluxes ϕ. The magnets 102 and 103 are polarized in directions opposite to each other. Therefore, the magnetic flux ϕ generated by the magnet 102 emanates from the north pole face, enters into the plate 104, and is then radiated from the top surface of the plate 104 to the air gap thereabove. The magnetic flux ϕ radiated from the top surface of the plate 104 is inputted to the plate 105 through the air gap above the magnet 102. Accordingly, a magnetic field, which is composed of the magnetic flux perpendicular to a vibration direction (the up-down direction in FIG. 2), is formed above the magnet 102, and then the magnetic gap G1 is formed above the magnet 102. The magnetic flux ϕ generated by the magnet 103 emanates from the north pole face, enters into the plate 104, and is then radiated from the top surface of the plate 104 to the air gap thereabove. The magnetic flux ϕ radiated from the top surface of the plate 104 is inputted to the plate 106 through the air gap above the magnet 103. Accordingly, a magnetic field, which is composed of the magnetic flux perpendicular to the vibration direction, is formed above the magnet 103, and the magnetic gap G2 is formed above the magnet 103.

Figure 3:
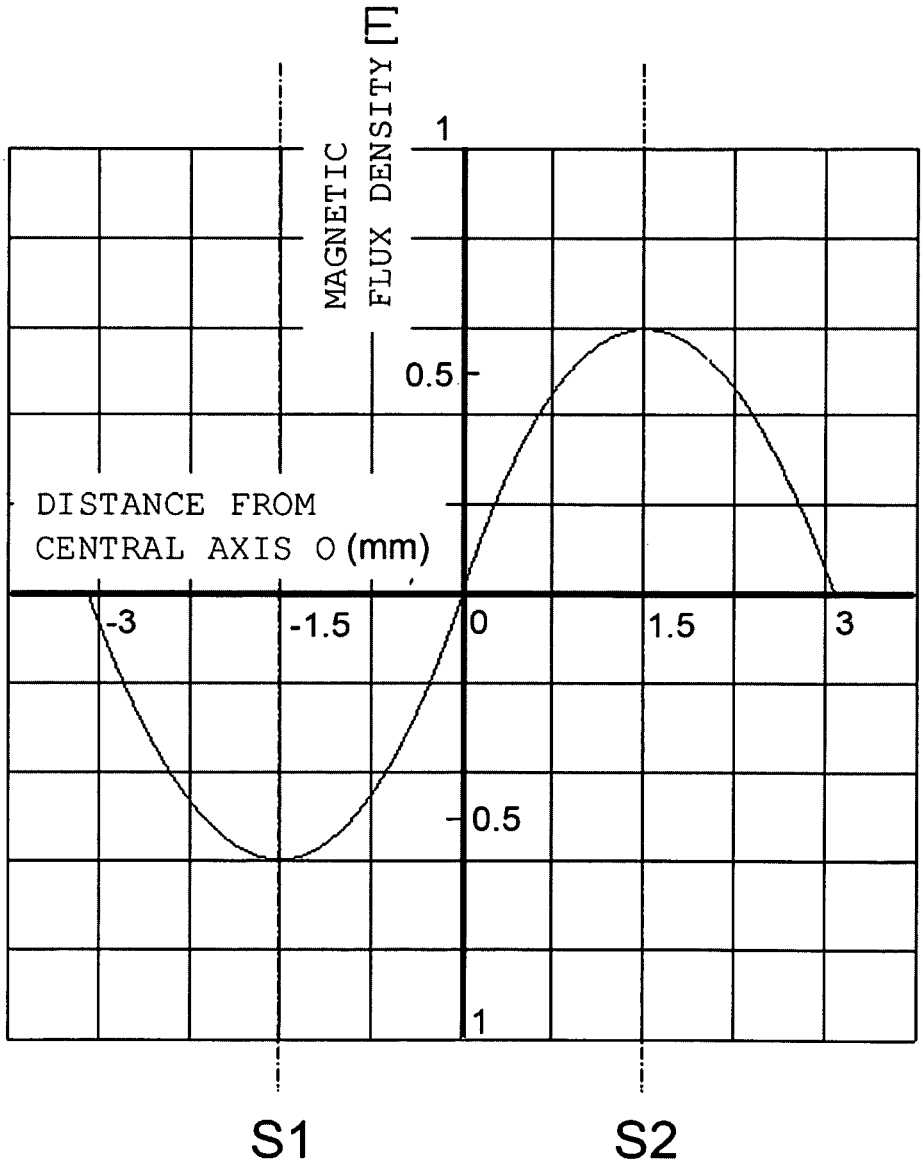
FIG. 3 is a diagram showing a magnetic flux density distribution in the case of a configuration shown in FIG. 1C.

A magnetic flux density distribution in a static magnetic field as above described is shown in FIG. 3. FIG. 3 is a diagram showing a magnetic flux density distribution in the case of a structure shown in FIG. 1C. The magnetic flux density distribution indicates a relation between a distance from the central axis O to a position on the diaphragm 107 in the short side direction and the magnetic flux density. As shown in FIG. 3, a vertical axis indicates the magnetic flux density. The magnetic flux density indicates a density of the magnetic flux in a direction perpendicular to the vibration direction of the diaphragm 107. The higher the magnetic flux density is, the more the magnetic flux is increased in the direction perpendicular to the vibration direction of the diaphragm 107. A horizontal axis indicates the distance from the central axis O on the diaphragm 107 in the short side direction, and a right side of the central axis O shown in FIG. 1C is a positive direction of the horizontal axis. In FIG. 3, a width of the plate 104 in the short side direction is 1 mm, a width of each of the magnets 102 and 103 in the short side direction is 2 mm, a width of each of the plates 105 and 106 in the short side direction is 1 mm, and a width of a range including the magnets 102 and 103 and the plates 104 to 106 is 8 mm.

As is clear from FIG. 3, a maximum value of the magnetic flux density is 0.6 [T], and the magnetic flux density having the maximum value appears at a position 1.5 mm from the central axis O. The position corresponds to the center of the width of each of the magnets 102 and 103 in the short side direction. That is, the position corresponds to each of the width central axes S1 and S2. Therefore, when the respective long sides of the coil 108 are situated in the vicinity of the width central axes S1 and S2, respectively, the drive force can be generated in the coil 108 efficiently. Further, when the centers of the widths of the wound coils composing the respective long sides of the coil 108 are situated immediately on the width central axes S1 and S2, respectively, the drive force is generated most efficiently in the coil 108.

In the case where the alternative current is supplied to the coil 108, the drive force is generated so as to be proportional to the magnetic flux which is perpendicular to a direction of the current flowing through the coil 108, and is also perpendicular to the vibration direction of the diaphragm 107. With the drive force, the diaphragm 107 bonded on the coil 108 vibrates, and the vibration is emitted as a sound.

Next, features and effects of the electro-acoustical transducer according to the present embodiment will be described.

Firstly, the diaphragm 107 is of an elongated shape, and thus a peak/dip is hardly caused by the resonance in the ultra-high frequency band, and accordingly a fluctuation in the sound-pressure frequency characteristic in the ultra-high frequency band, the fluctuation being caused by the resonance, is reduced. As to an aspect ratio of the diaphragm 107, when a length in the vertical direction (long side direction) 1, preferably, a length in the horizontal direction (short side direction) is 0.5 or less, that is, one half or less of the length in the vertical direction. A resonant frequency (first resonant frequency) of the first resonant mode in the short side direction is inversely proportional to a square of the resonant frequency (first resonant frequency) of the first resonant mode in the long side direction. Accordingly, when the aspect ratio of the diaphragm 107 is 1:0.5, and when the first resonant frequency in the long side direction is fL1 [Hz], the first resonant frequency fS1 in the short side direction is 4*fL1. A resonant frequency (second resonant frequency) of the second resonant mode is 5.4 times the first resonant frequency, and thus a second resonant frequency fS2 in the short side direction is 5.4*fS1=5.4*4*fL1=21.6*fL1 [Hz]. Accordingly, when the aspect ratio of the diaphragm 107 is 1:0.5, it is possible to reduce the fluctuation in the sound-pressure frequency characteristic in the long side direction up to a frequency band which is 21.6 times the first resonant frequency. Further, when the aspect ratio of the diaphragm 107 is 1:0.3, the first resonant frequency fS1 in the short side direction is 11.1*fL1 [Hz], and thus the second resonant frequency fS2 in the short side direction is 60*fL1. Therefore, in this case, it is possible to reduce the fluctuation in the sound-pressure frequency characteristic in the long side direction up to a frequency which is 60 times the first resonant frequency. In this manner, a resonance suppression effect in the present embodiment is increased when aspect ratio of the diaphragm 107 increases, that is, when the diaphragm 107 is elongated further.

Secondly, the respective long sides of the coil 108 are situated in the vicinity of the nodal lines of the first resonant mode in the short side direction of the diaphragm 107. Therefore, it is possible to suppress the first resonant mode occurring on the diaphragm 107 in the short side direction, and consequently, it is possible to reduce the fluctuation in the sound-pressure frequency characteristic in the ultra-high frequency band. Further, the length of the coil 108 in the long side direction is at least 60% of the length of the diaphragm 107 in the long side direction. Therefore, the diaphragm 107 is driven in its whole length in the long side direction, and thus it is possible to suppress the resonant mode occurring on the diaphragm 107 in the long side direction. Accordingly, it is possible to reduce the fluctuation in the sound-pressure frequency characteristic in the ultra-high frequency band. In this manner, when the respective long sides of the coil 108 are situated in the vicinity of the nodal lines of the first resonant mode in the short side direction of the diaphragm 107, or when the length of the coil 108 in the long side direction is at least 60% of the length of the diaphragm 107 in the long side direction, it is possible to expand a frequency band, in which a sound can be reproduced without having the fluctuation in the sound-pressure frequency characteristic, to a further higher frequency band compared to a case where the diaphragm 107 is merely of the elongated shape.

Thirdly, the respective long sides of the coil 108 are situated on or in the vicinity of the width central axes S1 and S2, respectively. Accordingly, it is possible to generate the drive force efficiently in the coil 108, and consequently, it is possible to improve a reproduced sound pressure level.

Figure 23A:
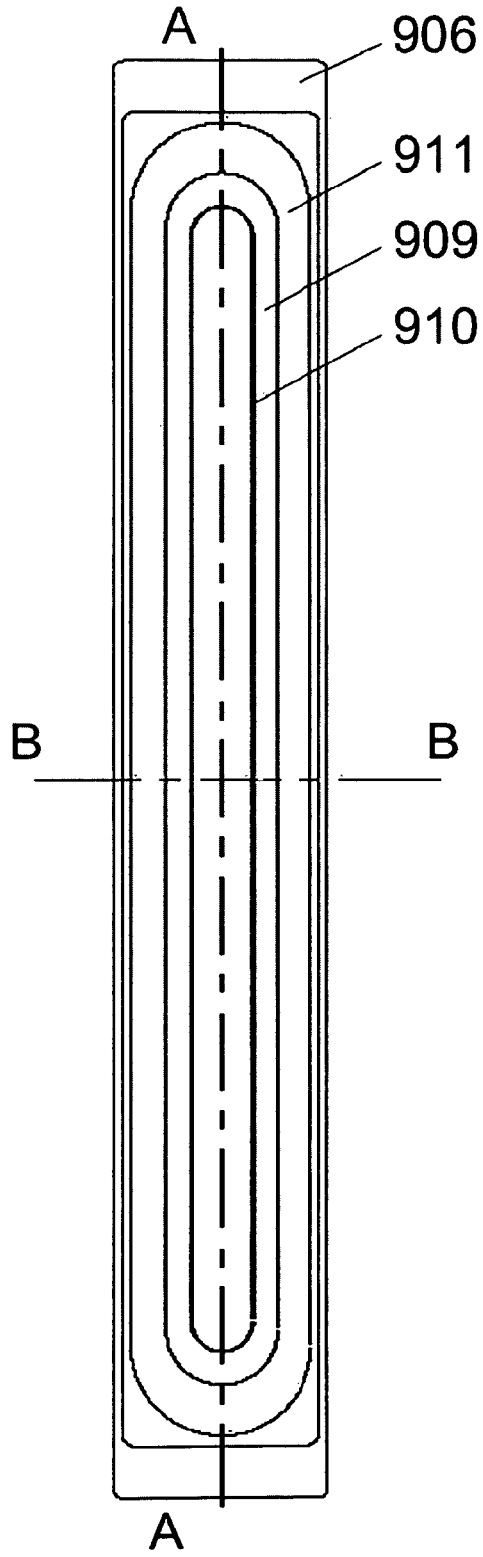
Fig 23A PRIOR ART
FIG. 23A is a front view of another conventional electro-acoustical transducer.
Figure 23B:
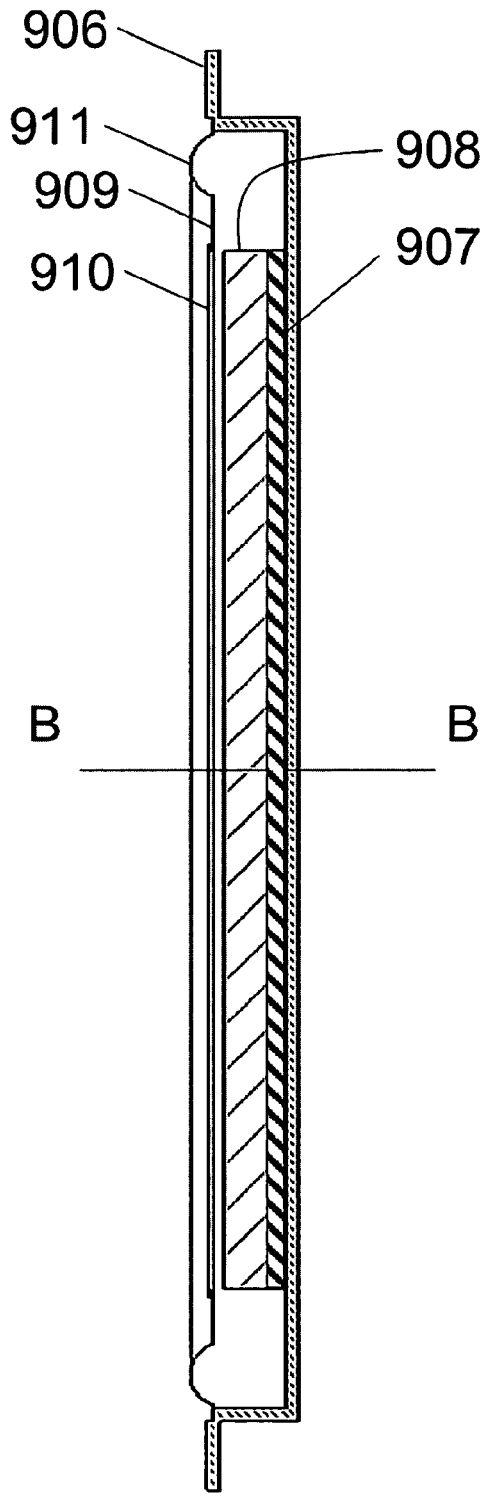
Fig 23B PRIOR ART
FIG. 23B is a cross sectional view of the electro-acoustical transducer as cut along a center line AA in a long side direction shown in FIG. 23A.
Figure 23C:
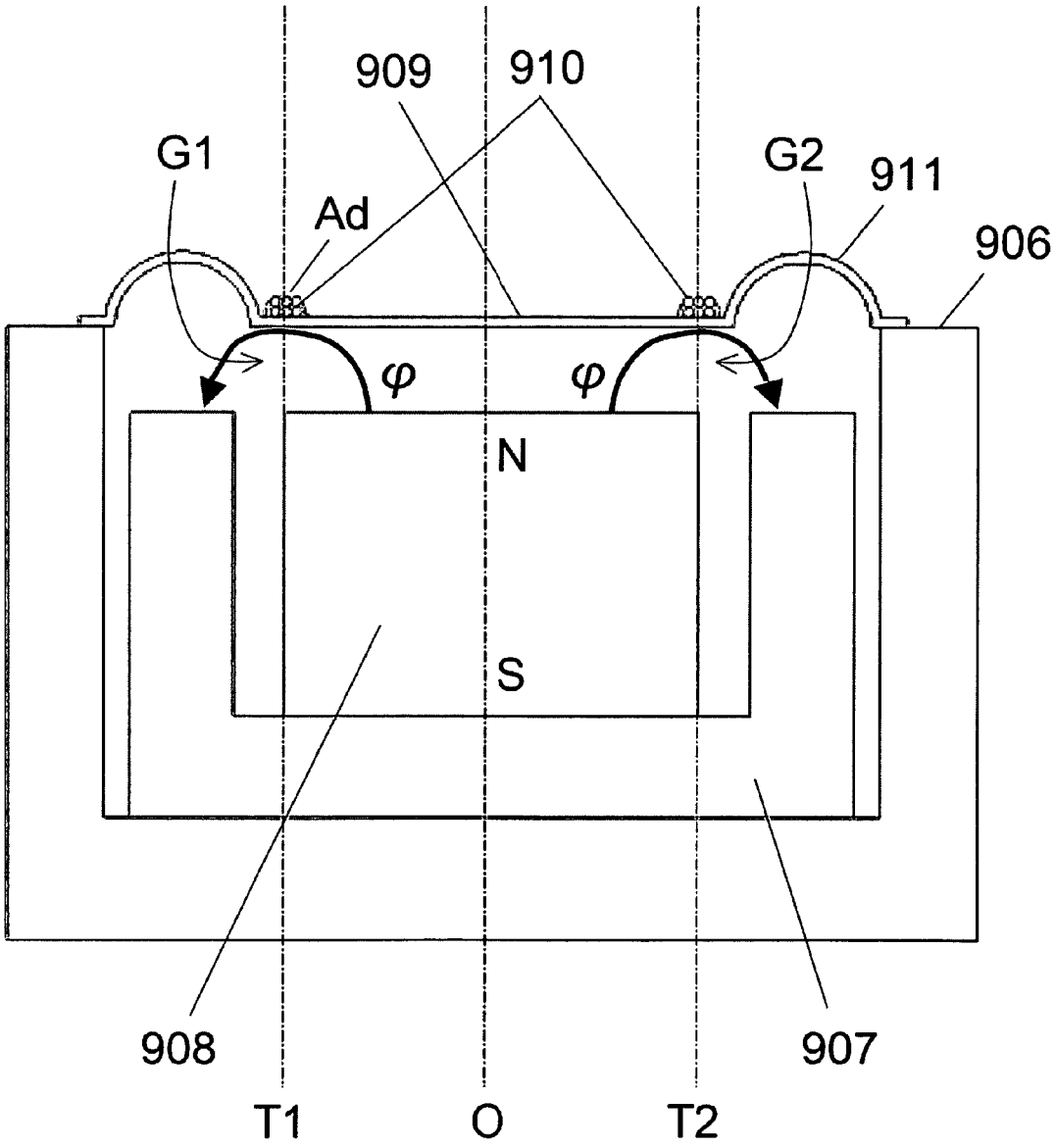
Fig 23C PRIOR ART
FIG. 23C is a cross sectional view of the electro-acoustical transducer as cut along a center line BB in a short side direction shown in FIG. 23A.
Figure 24:
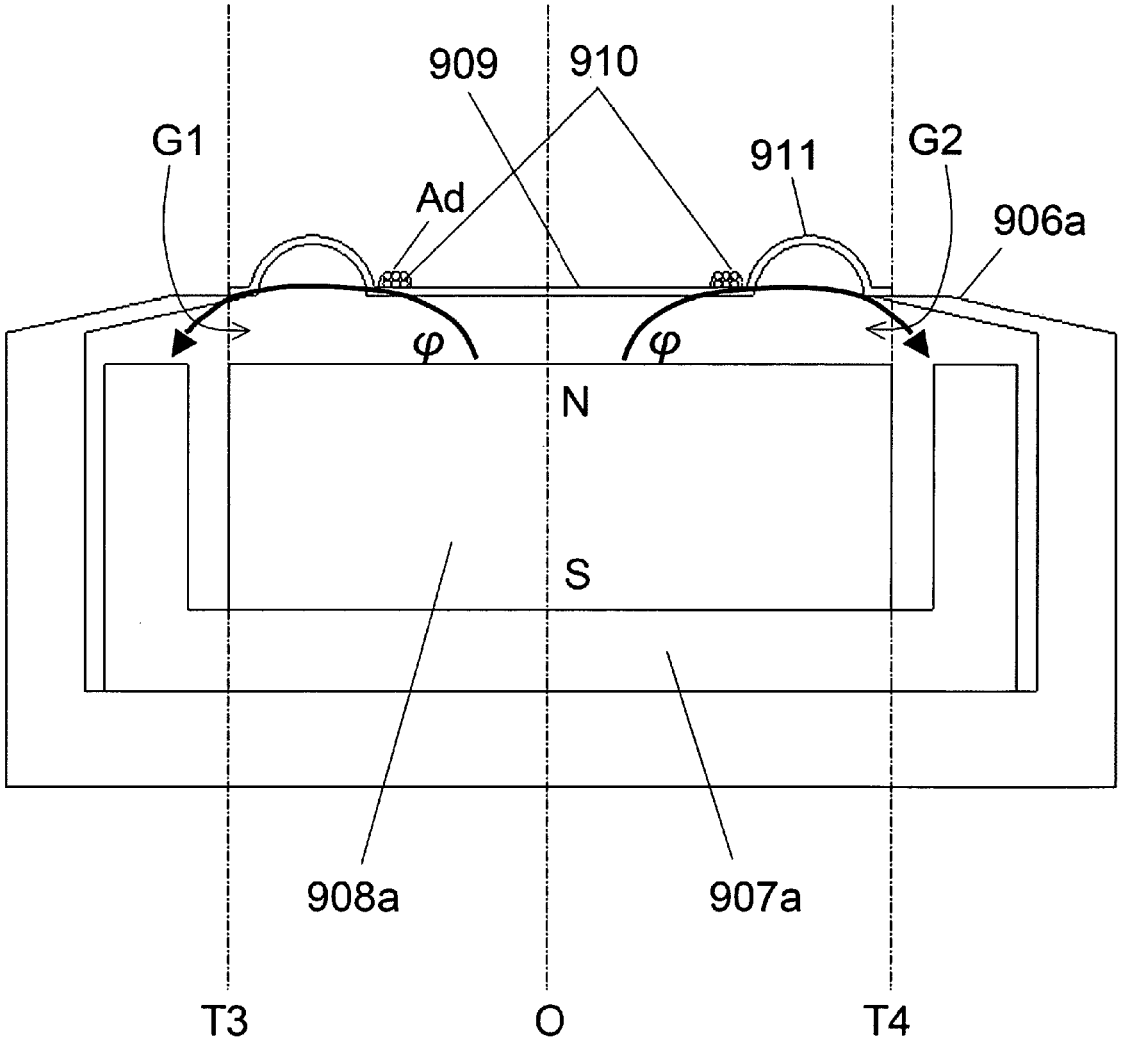
Fig 24 PRIOR ART
FIG. 24 is a cross sectional view of the electro-acoustical transducer shown in FIGS. 23A, 23B and 23C in which a width in the short side direction of a magnet 908 is increased.
Figure 25:
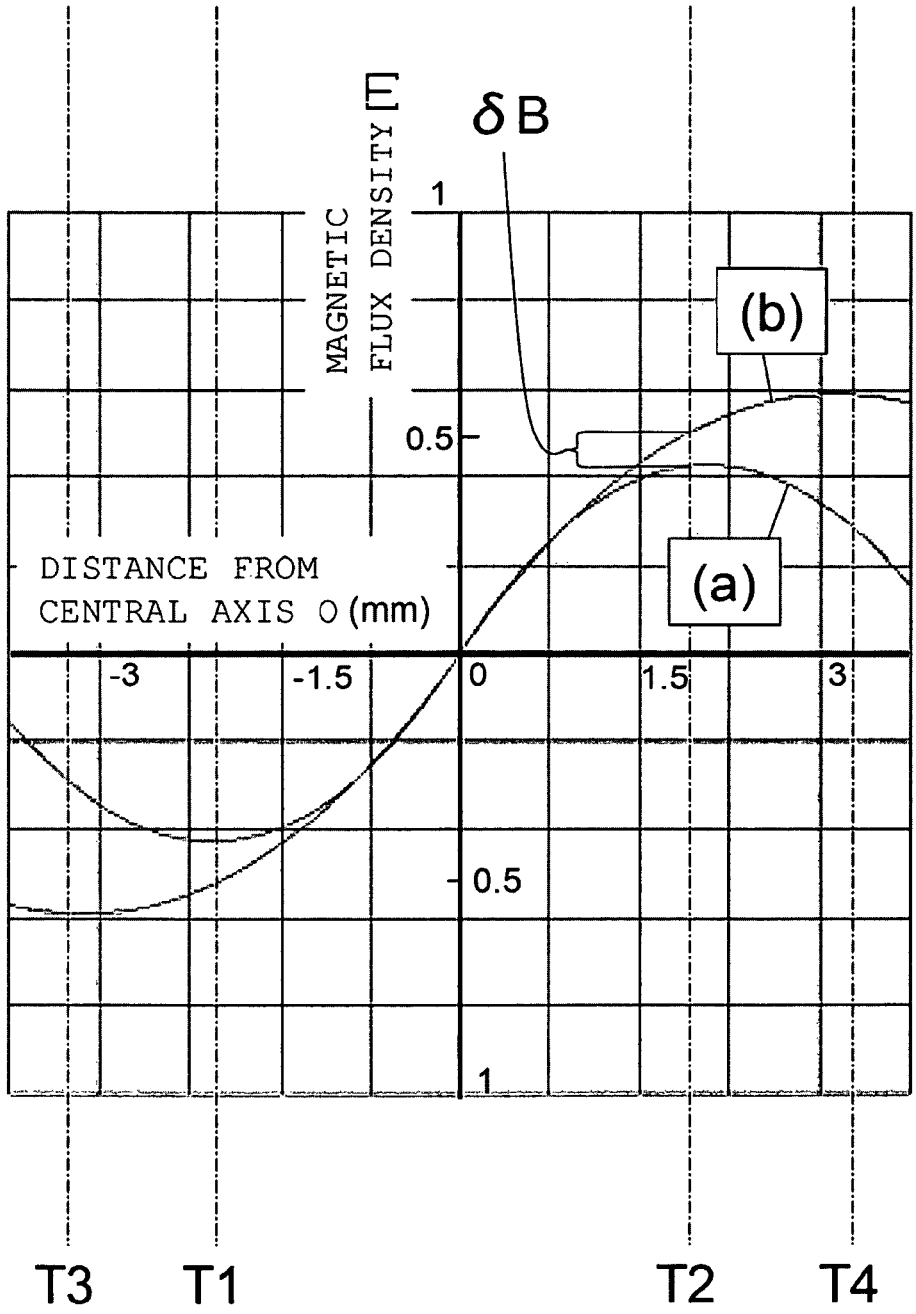
Fig 25 PRIOR ART
FIG. 25 is a diagram showing a result of comparison between magnetic flux densities in accordance with coil positions.

Fourthly, the magnets 102 and 103 are each polarized in the short side direction of the diaphragm 107. In the case of the conventional electro-acoustical transducer as shown in FIGS. 23A, 23B and 23C, in order to improve the reproduced sound pressure level by increasing the magnetic flux in the direction perpendicular to the vibration direction of the diaphragm, the width of the magnet 908 in the short side direction needs to be increased. However, since the width of the diaphragm 909 in the short side direction cannot be increased, it is impossible to efficiently increase the magnetic flux in the direction perpendicular to the vibration direction of the diaphragm. On the other hand, the electro-acoustical transducer according to the present embodiment has a configuration in which the magnets 102 and 103 are each polarized in the short side direction of the diaphragm 107. Therefore, in the electro-acoustical transducer according to the present embodiment, in order to improve the reproduced sound pressure level by increasing the magnetic fluxes in the direction perpendicular to the vibration direction of the diaphragm, the width of each of the magnets 102 and 103 in the vibration direction of the diaphragm 107 (the up-down direction in FIG. 1C) is increased. Further, even when the width of each of the magnets 102 and 103 in the vibration direction of the diaphragm 107 is increased, a position where the magnetic flux density indicates a maximum value does not vary unlike the conventional electro-acoustical transducer. Accordingly, in the electro-acoustical transducer according to the present embodiment, it is possible to efficiently increase the magnetic flux in the direction perpendicular to the vibration direction of the diaphragm, while the fluctuation in the sound-pressure frequency characteristic in the ultra-high frequency band is reduced. As a result, it is possible to realize an improved sound reproduction in the ultra-high frequency band. In the electro-acoustical transducer according to the present embodiment, the magnets are to be expanded in a direction at 90 degrees relative to the direction in the case of the conventional electro-acoustical transducer. Therefore, the electro-acoustical transducer according to the present embodiment is suitable for use in a diaphragm of an elongated shape.

Figure 4:
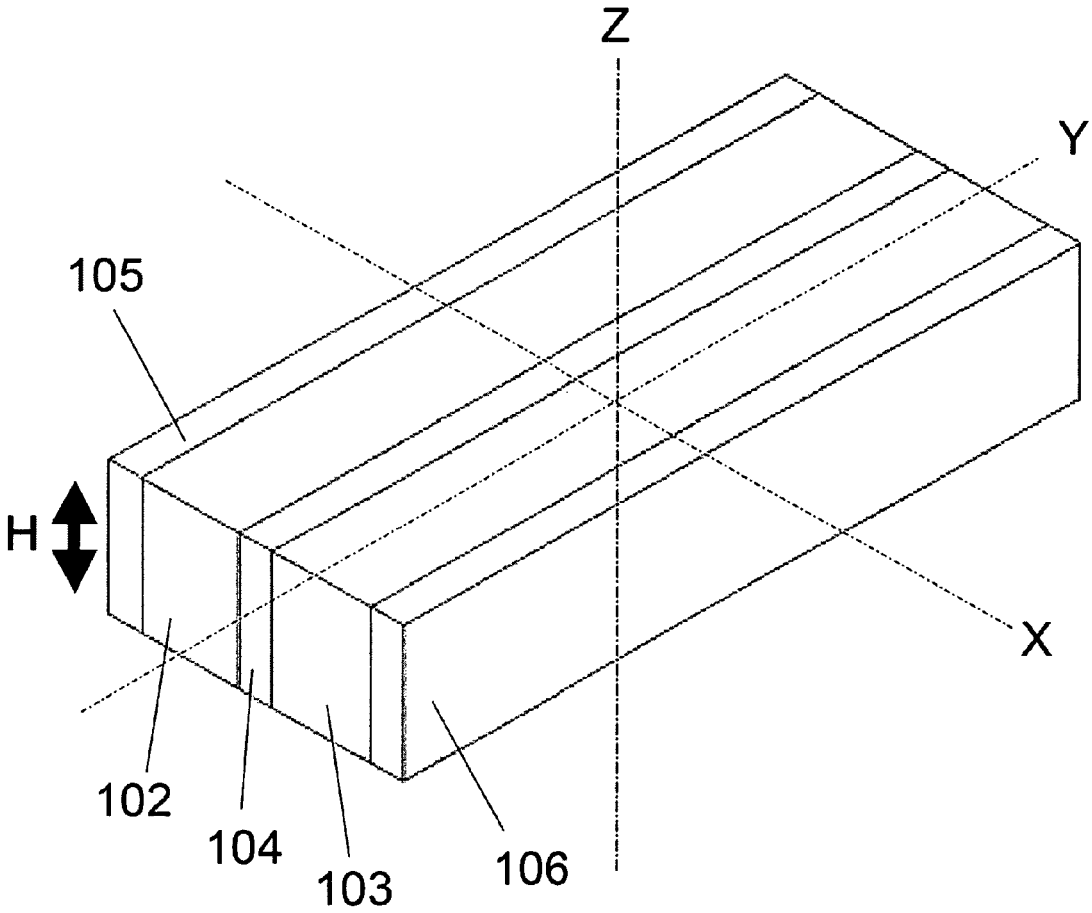
FIG. 4 is a perspective view of a magnetic circuit constituting the electro-acoustical transducer shown in FIG. 1C as viewed from an angle.
Figure 5:
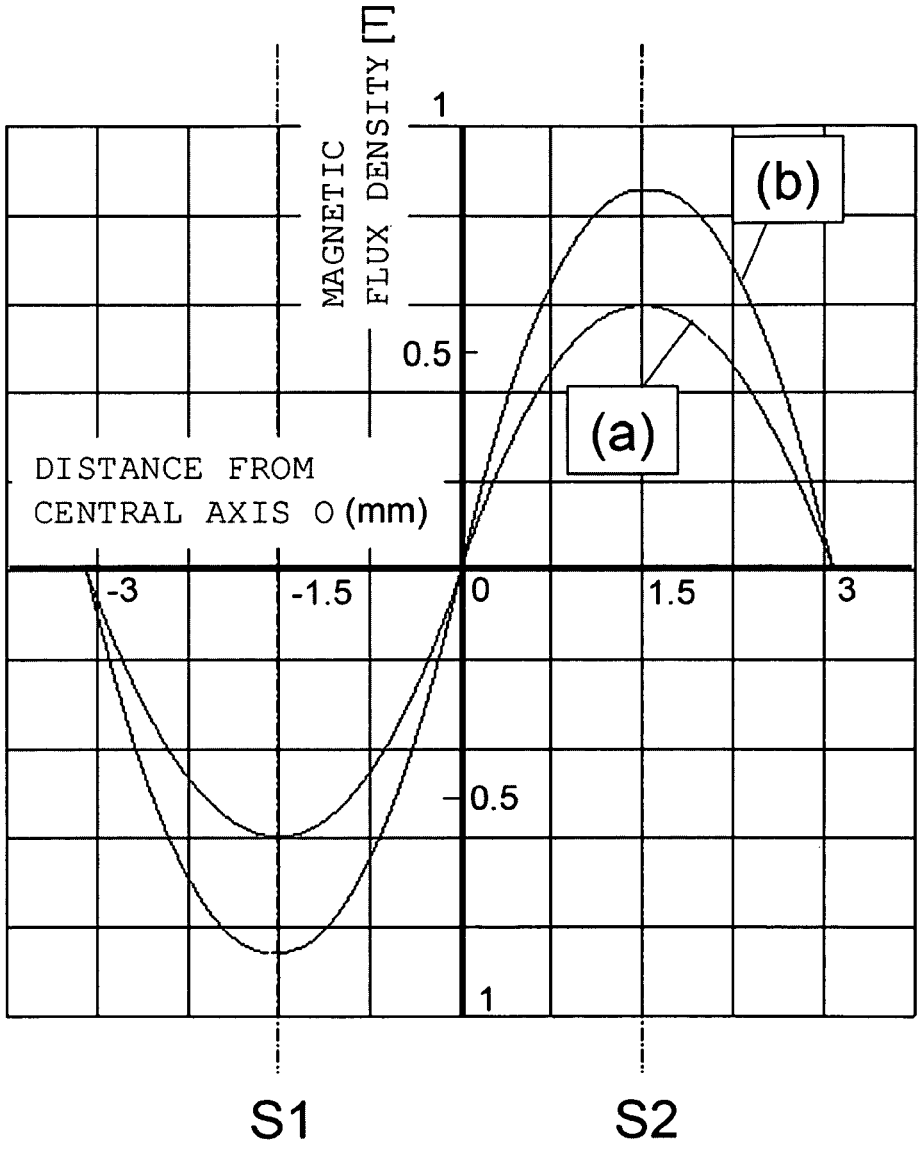
FIG. 5 is a diagram showing a relation between changes in widths of magnets 102 and 103 in a vibration direction of a diaphragm 107 and a change in the magnetic flux density distribution.

Hereinafter, with reference to FIGS. 4 and 5, the above-described fourth feature will be studied. FIG. 4 is a perspective view of a magnet circuit (the magnets 102 and 103, the plates 104 to 106) constituting the electro-acoustical transducer shown in FIG. 1C, as viewed from an angle. As shown in FIG. 4, the short side direction of each of the magnets 102 and 103 represents an X-axis, the long side direction thereof represents a Y-axis, and the vibration direction of the diaphragm 107 represents a Z-axis. FIG. 5 is a diagram showing a relation between a change in widths of the magnets 102 and 103 in the vibration direction of the diaphragm 107, and a change in the magnetic flux density distribution.

In FIG. 4, in order to increase the magnetic flux density, each of the magnets 102 and 103 is expanded in the Z-axis direction, instead of the X-axis direction. That is, in order to increase the magnetic flux density, the width of each of the magnets 102 and 103 in the X-axis direction does not need to be increased. Here, suppose that the width of each of the magnets 102 and 103 in the Z-axis direction is H. With reference to FIG. 5, a change in the magnetic flux density will be described in the case where H is changed. In FIG. 5, a graph (a) is the same as that shown in FIG. 3. That is, the graph (a) shows a magnetic flux density distribution in the case of H=8 mm. A graph (b) shows a magnetic flux density distribution in the case of H=13 mm. The maximum value of the magnetic flux density indicated by the graph (a) is 0.6[T], whereas the maximum value of the magnetic flux density indicated by the graph (b) is 0.85[T]. Further, the maximum magnetic flux density appears at H=1.5 mm in each of the graphs (a) and (b). When the value of H increases therefrom, the maximum value of the magnetic flux density increases from 0.6[T] to 0.85[T]. However, the position where the magnetic flux density indicates the maximum value stays at H=1.5 mm. In this manner, in the present embodiment, it is possible to increase the magnetic flux density without changing the position of each of the long sides of the coil 108.

Figure 6:
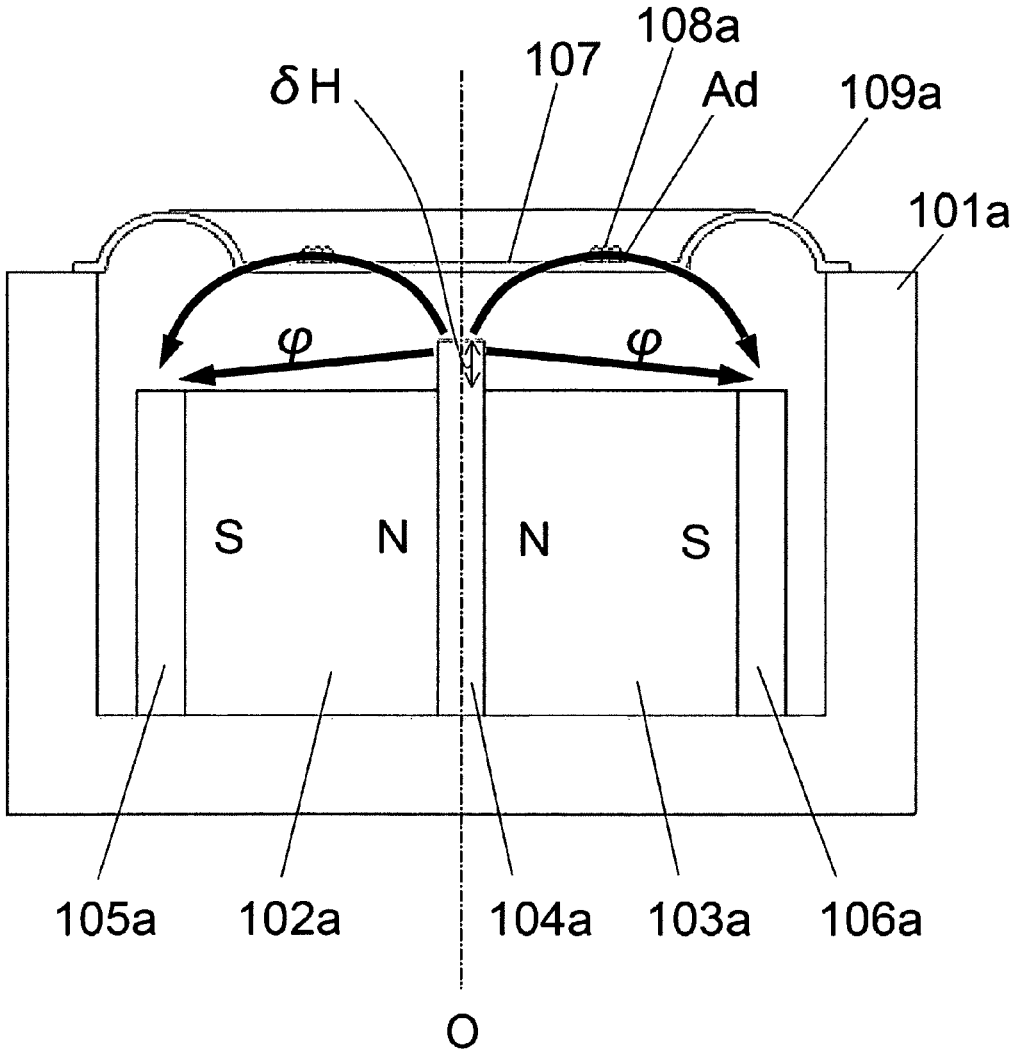
FIG. 6 is a tectonic profile of the electro-acoustical transducer showing a relation between positions of top surfaces of plates 104 to 106 and the magnetic flux density distribution.
Figure 7:
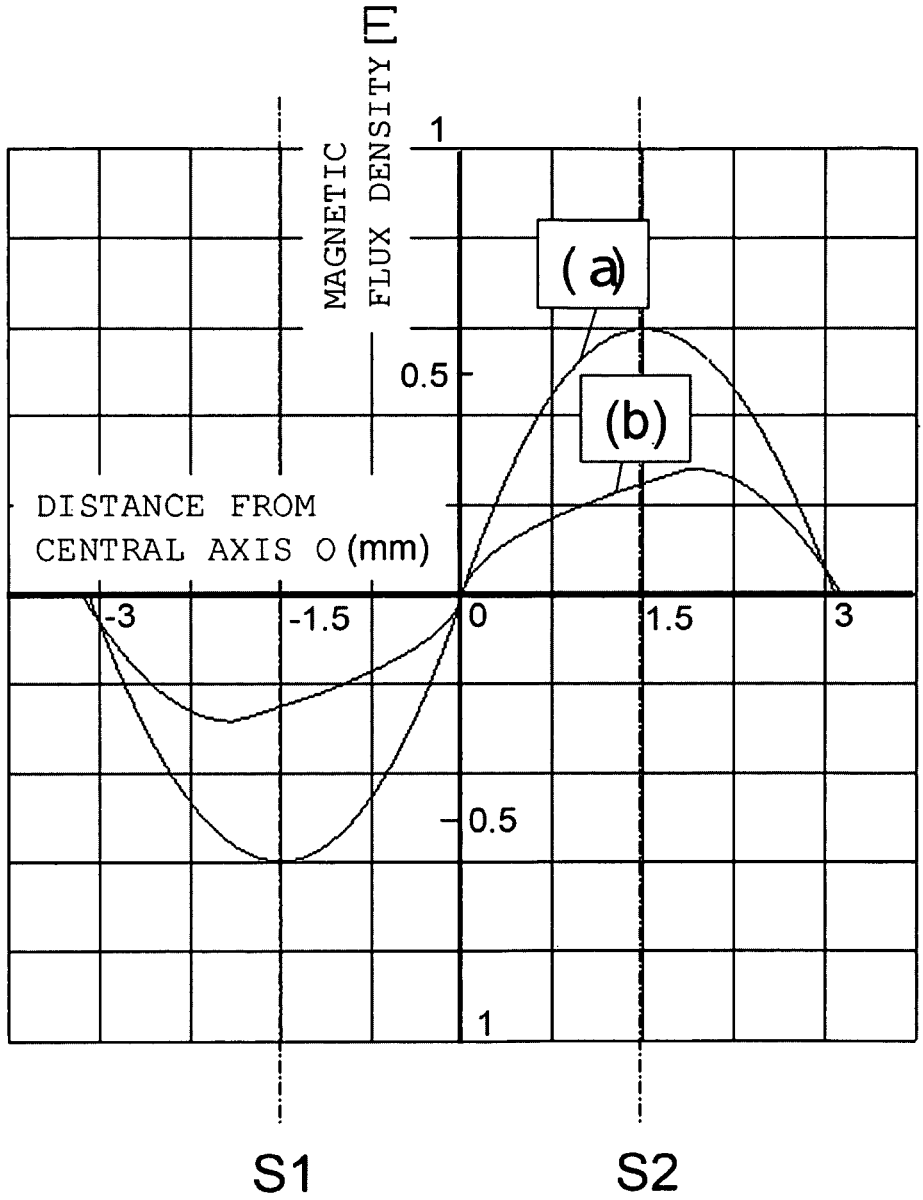
FIG. 7 is a diagram showing a relation between the positions of the top surfaces of the plates 104 to 106 and the magnetic flux density distribution.

Fifthly, the top surface of the plate 104 and the magnets 102 and 103 are at a common height, and are situated on a common plane. An effect of such configuration will be described with reference to FIGS. 6 and 7. FIG. 6 is a tectonic profile of the electro-acoustical transducer showing a relation between positions of top surfaces of the plates 104 to 106 and the magnetic flux density distribution. FIG. 7 is a diagram showing a relation between the positions of the top surfaces of the plates 104 to 106 and the magnetic flux density distribution.

As shown in FIG. 6, the electro-acoustical transducer includes a frame 101*a*, magnets 102*a* and 103*a*, plates 104*a* to 106*a*, a diaphragm 107*a*, a coil 108*a* and an edge 109*a*. A structure of the electro-acoustical transducer shown in FIG. 6 is greatly different from the structure shown in FIG. 1C in that a height of a top surface of the plate 104*a* is higher than a height of a top surface of each of the magnets 102*a* and 103*a*. The remaining parts of the structure are basically the same as those shown in FIG. 1C, and thus description thereof will be omitted.

The top surface of the plate 104*a* is situated at a position higher by δH than the top surface of each of the magnets 102*a* and 103*a*. In other words, the plate 104*a* protrudes upward by δH from a height position of the top surface of each of the magnets 102*a* and 103*a*. In such structure, the magnetic fluxes ϕ are radiated not only from the top surface of the plate 104*a*, but also from side surfaces of the protruding portion of the plate 104. The magnetic fluxes ϕ radiated from the side surfaces do not pass through the coil 108*a*, but are inputted to the plates 105*a* and 106*a*. Since the magnetic fluxes ϕ radiated from the plate 104*a* are constant, an amount of the magnetic fluxes ϕ passing through the coil 108*a* is reduced by an amount of the magnetic fluxes ϕ which are radiated from the side surfaces and which do not pass through the coil 108*a*.

In FIG. 7, the vertical-axis indicates a magnetic flux density, and the horizontal-axis indicates a distance from a central axis O in a short side direction of the diaphragm 107*a*. In FIG. 7, the right side of the central axis shown in FIG. 6 is a positive direction of the horizontal-axis. Further in FIG. 7, a width of the plate 104*a* in the short side direction is 1 mm, and a width of each of the magnets 102*a* and 103*a* in the short side direction is 2 mm. A width of the plates 105*a* and 106*a* in the short side direction is 1 mm, and a width of each of the magnets 102*a* and 103*a* and plates 105*a* and 106*a* in the vibration direction of the diaphragm 107*a* is 8 mm. As shown in FIG. 7, a graph (a) shows a magnetic flux density distribution in the case where the top surface of the plate 104*a* is at the same height as the top surface of each of the magnets 102*a* and 103*a* (in the case of δH=0). A graph (b) in FIG. 7 shows a magnetic flux density distribution in the case where the top surface of the plate 104*a* is higher by 0.5 mm than the top surface of each of the magnets 102*a* and 103*a* (in the case of δH=0.5). As shown in FIG. 7, the magnetic flux density indicated by graph (b) is lower than that indicated by graph (a). In this manner, the top surface of the plate 104 and the top surface of each of the magnets 102 and 103 are situated on the common plane, and it is possible to obtain a higher magnetic flux density.

As above-described, the electro-acoustical transducer according to the present embodiment is capable of efficiently improving the reproduced sound pressure level in the ultra-high frequency band, and is capable of realizing an improved sound reproduction in the ultra-high frequency band.

Figure 8:
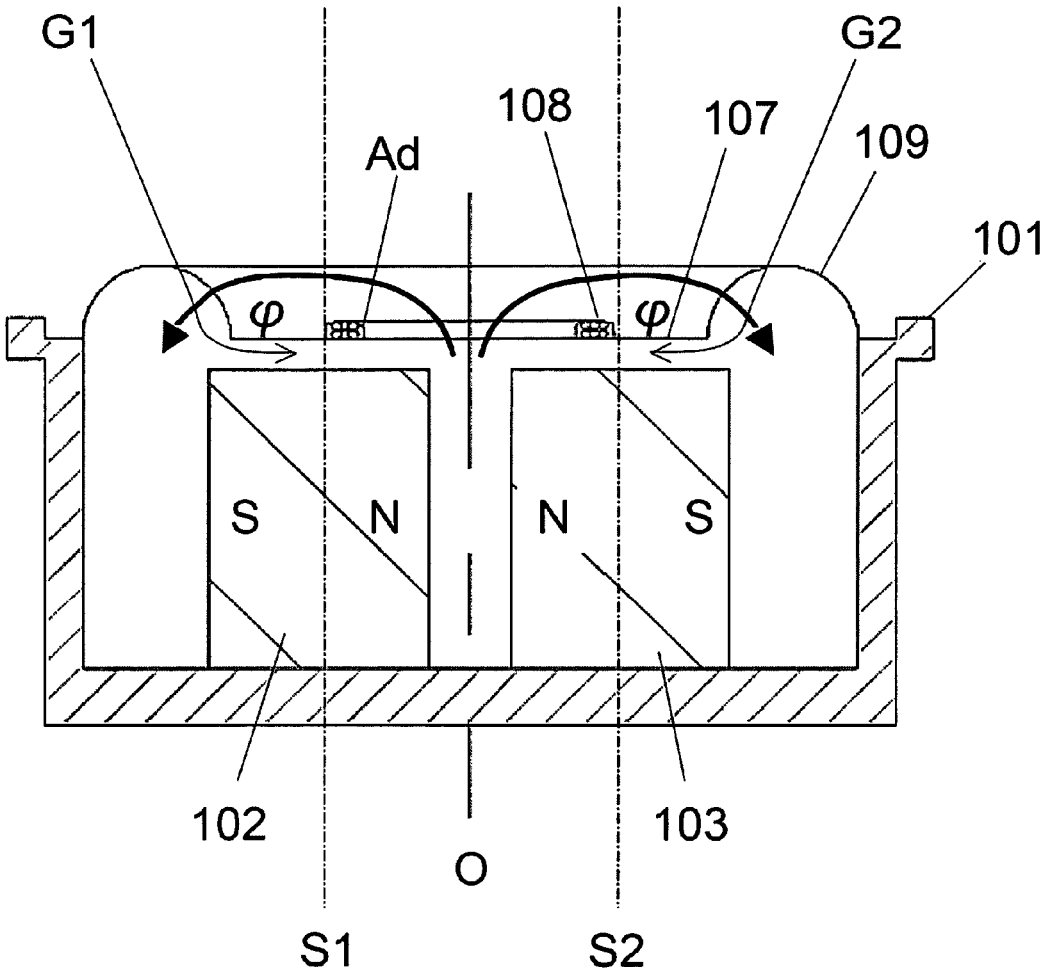
FIG. 8 is a tectonic profile of the electro-acoustical transducer according to the first embodiment, as viewed from the short side direction, from which the plates 104 to 106 are removed.
Figure 9:
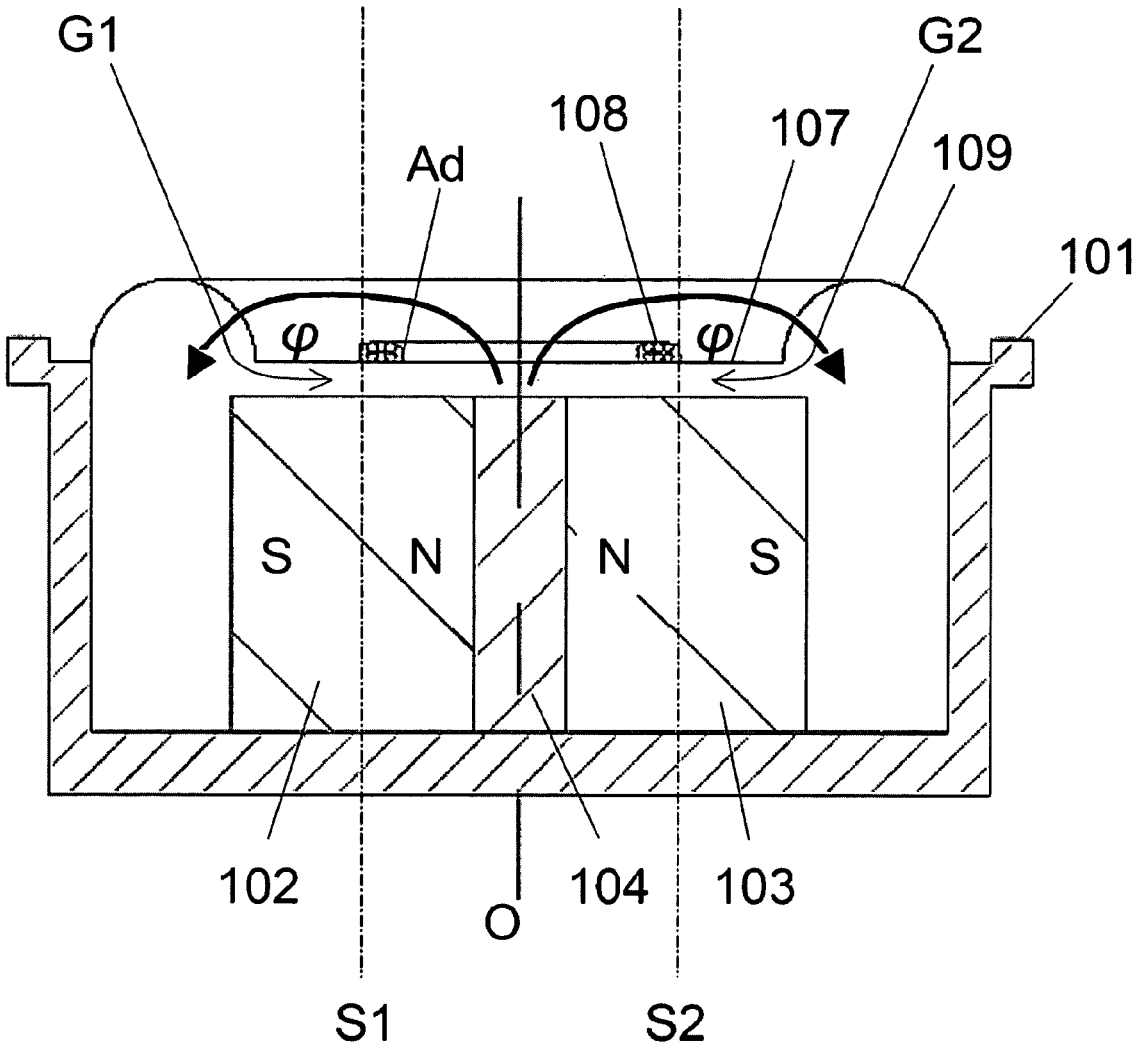
FIG. 9 is a tectonic profile of the electro-acoustical transducer according to the first embodiment, as viewed from the short side direction, from which the plates 105 and 106 are removed.
Figure 10:
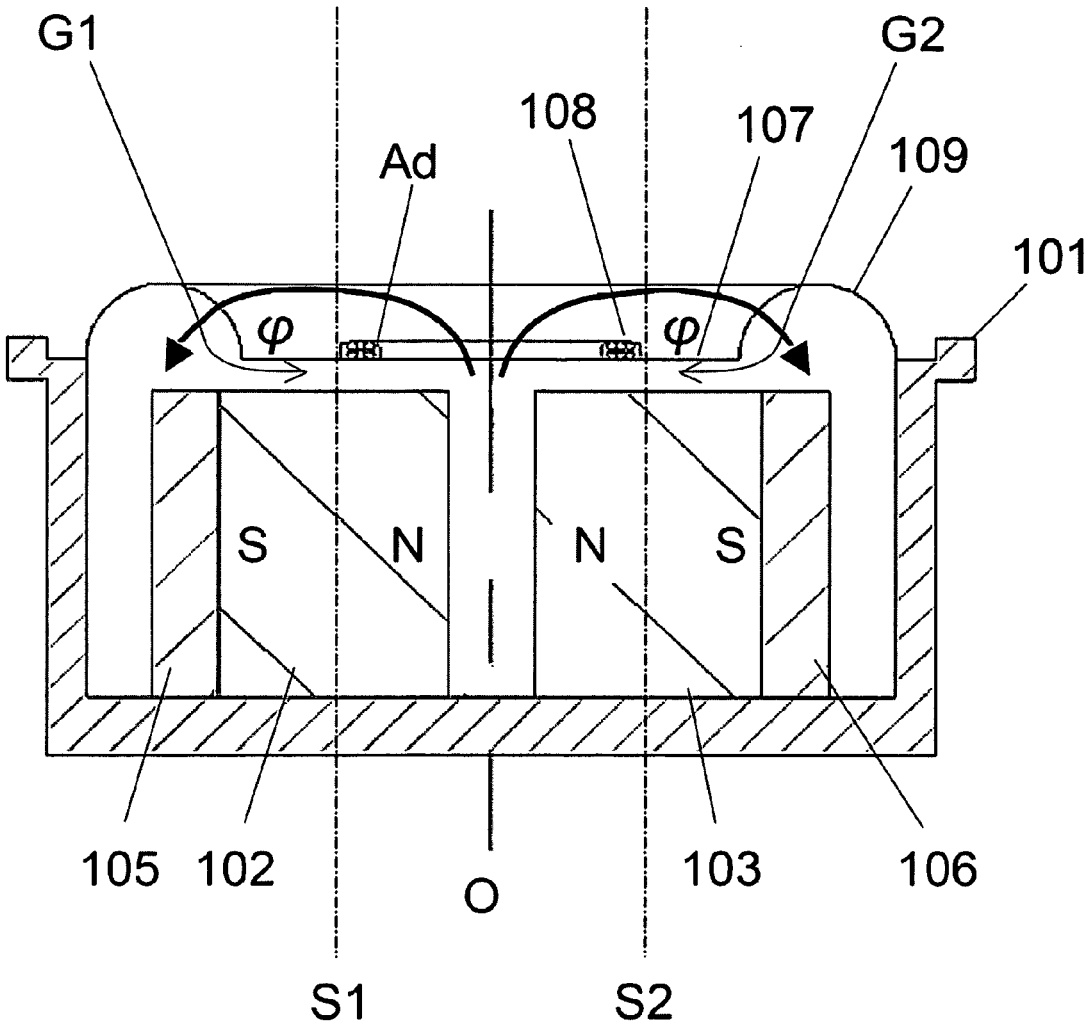
FIG. 10 is a tectonic profile of the electro-acoustical transducer according to the first embodiment, as viewed from the short side direction, from which the plate 104 is removed.

In the present embodiment, the plates 104 to 106 are used, however, the plates may be omitted as shown in FIG. 8. FIG. 8 is a tectonic profile of the electro-acoustical transducer according to the first embodiment, as viewed from the short side direction, from which the plates 104 to 106 are removed. In the structure shown in FIG. 8, in order to improve the reproduced sound pressure level by increasing the magnetic flux in the direction perpendicular to the vibration direction of the diaphragm, the width in the vibration direction (an up-down direction in FIG. 8) of the diaphragm 107 within the range above the magnets 102 and 103 is increased. Even if the width of the vibration direction of the diaphragm 107 within the range above the magnets 102 and 103 is increased, the position where the magnetic flux density indicates the maximum value does not vary unlike the case of the conventional electro-acoustical transducer. Therefore, even with the structure shown in FIG. 8, it is possible to realize the improved sound reproduction in the ultra-high frequency band. As long as the magnets 102 and 103 which are polarized in the short side direction of the diaphragm 107 are included, it is possible to realize the improved sound reproduction in the ultra-high frequency band. Therefore, as shown in FIGS. 9 and 10, either of the plate 104 or the plates 105 and 16 may be omitted. FIG. 9 is a tectonic profile of the electro-acoustical transducer according to the first embodiment, as viewed from the short side direction, from which the plates 105 and 106 are removed. FIG. 10 is a tectonic profile of the electro-acoustical transducer according to the first embodiment, as viewed from the short side direction, from which the plate 104 is removed.

The present embodiment is exemplified by the magnets 102 and 103 which are each made from the neodymium magnet, but is not limited thereto. The magnets 102 and 103 may be replaced with such magnets that are made from ferrite, samarium-cobalt and the like in accordance with a target sound pressure and shapes of the magnets. Further, in the present embodiment, the magnets 102 and 103 are each of the parallelepiped shape, but may be of another shape such as an elliptic cylinder shape.

In the present embodiment, the cross sectional shape of the edge 109 is a semicircle shape, but is not limited thereto. The cross sectional shape of the edge 109 may be determined so as to satisfy a minimum resonant frequency and a maximum amplitude, and may be of a corrugated shape or an elliptical shape, for example.

In the present embodiment, the coil 108 is bonded on the top surface of the diaphragm 107 with the adhesive agent Ad, however, the coil 108 and the diaphragm 107 may be molded in a unified manner.

In the present embodiment, the electro-acoustical transducer includes the magnets 102 and 103, however, either of the magnets may be removed. For example, in FIG. 1C, when the magnet 102 is omitted, the width of the short side of the magnet 103 is set equal to or more than a distance between the width central axes S1 and S2. Further, the coil 108 is cut and divided, along the central axis O, into two, and the electrical current is supplied, in the same direction, to a long side of each of the divided coils 108. Accordingly, with the magnetic gap G2 formed above the magnet 103, the drive forces are generated in the respective long sides of the coil 108 in the same direction. In this manner, if either of the magnets 102 or 103 is removed, it is possible to realize a cheaper magnet circuit since a cost of the removed magnet can be saved.

Second Embodiment

Figure 11A:
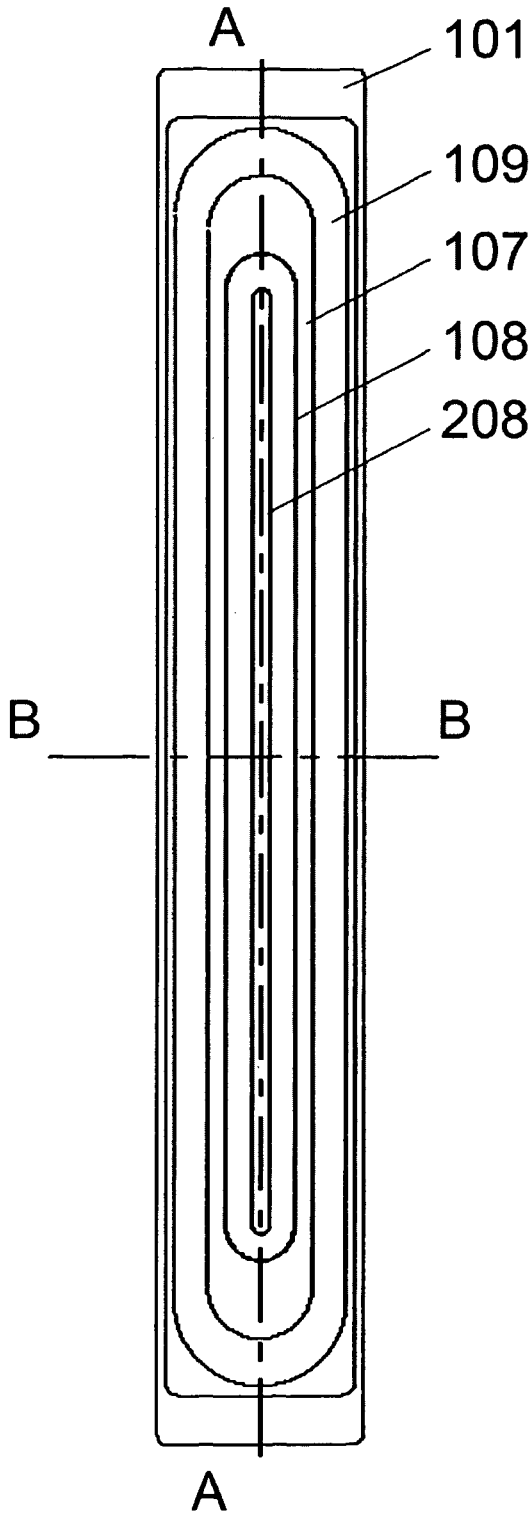
FIG. 11A is a front view of an electro-acoustical transducer according to a second embodiment.
Figure 11B:
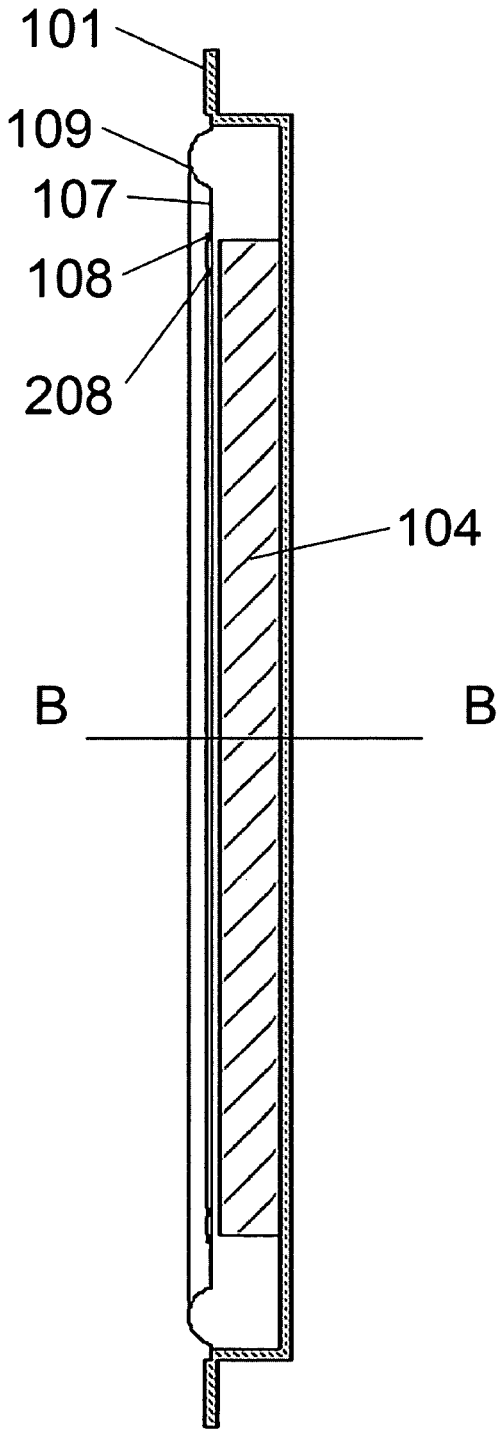
FIG. 11B is a cross sectional view of the electro-acoustical transducer as cut along a center line AA in a long side direction shown in FIG. 11A.
Figure 11C:
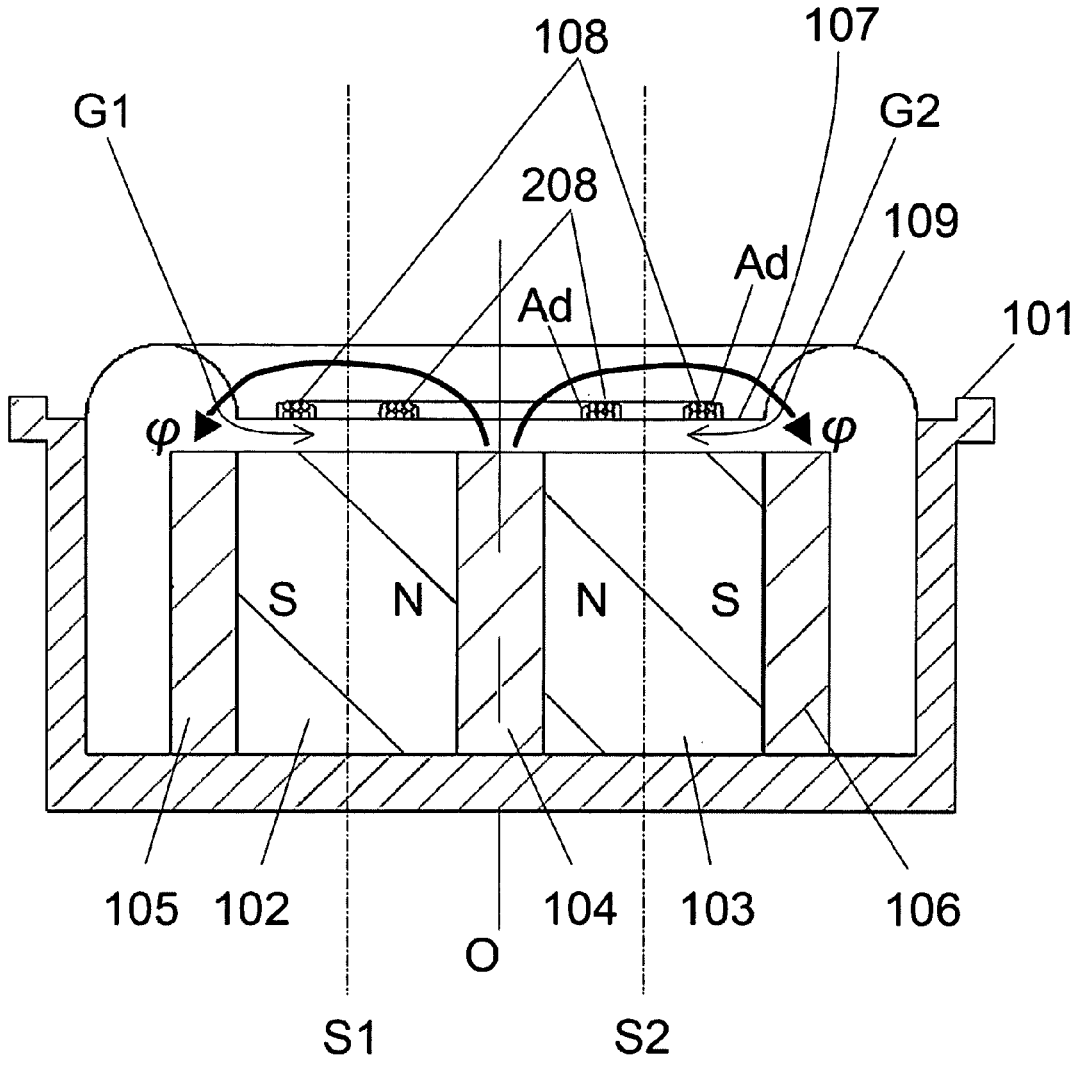
FIG. 11C is a cross sectional view of the electro-acoustical transducer as cut along a center line BB in a short side direction shown in FIG. 11A.

Hereinafter, with reference to FIGS. 11A, 11B and 11C, a structure of an electro-acoustical transducer according to a second embodiment of the present invention will be described. FIGS. 11A, 11B and 11C are diagrams each showing an example of the electro-acoustical transducer according to the second embodiment. FIG. 11A is a front view. FIG. 11B is a cross sectional view of the electro-acoustical transducer as cut along a center line AA in the long side direction shown in FIG. 11A. FIG. 11C is a cross sectional view of the electro-acoustical transducer as cut along a center line BB in the short side direction shown in FIG. 11A.

As shown in FIGS. 11A, 11B and 11C, the electro-acoustical transducer according to the second embodiment includes the frame 101, the magnets 102 and 103, the plates 104 to 106, the diaphragm 107, the coil 108, a coil 208, and the edge 109. Compared to the electro-acoustical transducer according to the first embodiment, the electro-acoustical transducer according to the present embodiment additionally includes the coil 208, and a location of the coil 108 is different from that in the electro-acoustical transducer according to the first embodiment. The remaining component parts are denoted by the same reference characters as those in the first embodiment, and detail descriptions thereof will be omitted. Hereinafter, different points will be mainly described.

The coil 208 is formed in an elongated ring shape by winding a copper wire or an aluminum wire several turns.

Here, the coil 208 is formed in an elongated track shape which is similar to the shapes of the diaphragm 107 and the coil 108. The coil 208 is bonded on the top surface of the diaphragm 107 so as to be located at an inner side of the coil 108. Further, the coil 208 is bonded such that long sides thereof are in parallel with the long sides of the diaphragm 107. The respective long sides of the coil 208 are situated within the ranges of the magnetic gaps G1 and G2, respectively. A length of the coil 208 in the long side direction is shorter than that of the coil 108, however, a length of the coil 208 in the long side direction is at least 60% of the length of the diaphragm 107 in the long side direction.

Hereinafter, the location of each of the coils 108 and 208 will be described. The respective long sides of the coils 108 and 208 are situated at positions to suppress the first resonant mode and the second resonant mode occurring on the diaphragm 107 in the short side direction. Suppose that, in FIG. 11C, the length of the short side direction of the diaphragm 107 measures 1, a left extremity of the diaphragm 107 measures 0, and the right extremity thereof measures 1. In this case, the respective long sides of the coil 108 is situated at positions, 0.1130 and 0.8770, and the respective long sides of the coil 208 is situated at positions, 0.37775 and 0.62225. With this allocation, it is possible to suppress the first and the second resonant modes.

When the respective width central axes S1 and S2 of the magnets 102 and 103 are set as references, the respective long sides of the coils 108 and 208 are situated such that a distance from one long side of the coil 108 to the one of the references is the same as a distance from one long side of the coil 208 to the same reference. That is, in FIG. 11C, the distance from the width central axis S1 to the long side of the coil 108 on the left side is the same as the distance from the central axis S1 to the long side of the coil 208 on the left side. In a similar manner, the distance from the width central axis S2 to the long side of the coil 108 on the right side is the same as the distance from the width central axis S2 to the long side of the coil 208 on the right side. As is clear from the above-described FIG. 3, the magnetic flux density reaches its maximum at the positions of the width central axes S1 and S2. Further, the magnetic flux density distribution in a range where the distance is 0 or more shows a symmetric shape with respect to the width central axis S2. In a similar manner, the magnetic flux density distribution in a range where the distance is smaller than 0 shows a symmetric shape with respect to the width central axis S1. Therefore, when the respective long sides of the coils 108 and 208 are situated as shown in FIG. 11C, the magnetic flux densities at positions of the respective long sides of the coils 108 and 208 are equal to each other. Accordingly, it is possible to obtain the most balanced drive forces. In order to situate the respective long sides of the coils 108 and 208 as shown in FIG. 11C, for example, the widths of the magnets 102 and 103 in the short side direction are adjusted as appropriate.

Next, an operation of the electro-acoustical transducer according to the second embodiment will be described. When an AC electrical signal is not supplied to the coils 108 and 208, the magnetic fluxes ϕ shown in FIG. 11C are caused by the magnets 102 and 103 and the plates 104 to 106. The magnets 102 and 103 are polarized in directions opposite to each other. Therefore, the magnetic flux ϕ generated by the magnet 102 emanates from the N pole face, enters into the plate 104, and then is radiated from the top surface of the plate 104 to the air gap thereabove. The magnetic flux ϕ radiated from the top surface of the plate 104 enters into the plate 105 through the air gap above the magnet 102. Accordingly, a magnetic field, which is composed of the magnetic flux perpendicular to the vibration direction (an up-down direction in FIG. 11C), is formed above the magnet 102, and the magnetic gap G1 is formed above the magnet 102. On the other hand, the magnetic flux ϕ generated by the magnet 103 emanates from the N pole face, enters into the plate 104, and then is radiated from the top surface of the plate 104 to the air gap thereabove. The magnetic flux ϕ radiated from the top surface of the plate 104 enters into the plate 106 through the air gap above the magnet 103. Accordingly, the magnetic field, which is composed of the magnetic flux perpendicular to the vibration direction is formed above the magnet 103, and the magnetic gap G2 is formed above the magnet 103. In the static magnetic field like this, the magnetic flux density reaches its maximum at the positions of the width central axes S1 and S2 as shown in FIG. 3. Therefore, the magnetic flux densities at the positions of the respective long sides of the coils 108 and 208 are equal to each other, and consequently the most balanced drive force is obtained.

When the AC electrical signal is supplied to the coils 108 and 208, the drive force is generated so as to be proportional to the magnetic flux which is perpendicular to a direction of the current flowing through each of the coils 108 and 208, and is also perpendicular to the vibration direction of the diaphragm 107. With the drive force, the diaphragm 107 bonded on the coils 108 and 208 is vibrated, and the vibration is emitted as a sound.

The respective long sides of the coils 108 and 208 are situated as the positions to suppress both of the first resonant mode and the second resonant mode occurring on the diaphragm 107 in the short side direction. Therefore, it is possible to suppress the first resonant mode and the second resonant mode occurring on the diaphragm 107 in the short side direction, and also possible to flatten the sound-pressure frequency characteristic up to a frequency where a third resonant mode occurs. The diaphragm 107 is of an elongated shape, and the width of the diaphragm 107 in the short side direction is shorter than the length of the diaphragm 107 in the long side direction. Therefore, respective resonant frequencies in the first resonant mode and the second resonant mode in the short side direction of the diaphragm 107 are significantly high. For example, suppose the diaphragm 107 is made from a polyimide material having a 50μ thickness, a 55 mm length in the long side direction, and a 5 mm length in the short side direction. In this case, the respective resonant frequencies in the first to third resonant modes in the short side direction of the diaphragm 107 are approximately 4 kHz, 22 kHz and 55 kHz. Therefore, when the first resonant mode and the second resonant mode are suppressed, it is possible to flatten the sound-pressure frequency characteristic up to the frequency of 55 kHz.

The lengths of the coils 108 and 208 in the long side direction are each at least 60% of the length of the diaphragm 107 in the long side direction. Therefore, the diaphragm 107 is driven in its whole length in the long side direction, whereby the resonant mode in the long side direction of the diagram can be suppressed. Accordingly, fluctuation in the sound-pressure frequency characteristic in ultra-high frequency band can be further reduced.

As above described, in the electro-acoustical transducer according to the present embodiment, the respective long sides of the coils 108 and 208 are situated at the positions to suppress both of the first resonant mode and the second resonant mode occurring on the diaphragm 107 in the short side direction. Therefore, it is possible to suppress the first resonant mode and the second resonant mode occurring on the diaphragm 107 in short side direction, and also possible to flatten the sound-pressure frequency characteristic up to the frequency where the third resonant mode occurs.

Further, in the electro-acoustical transducer according to the present embodiment, when the respective width central axes S1 and S2 of the magnets 102 and 103 are set as the references, the respective long sides of the coils 108 and 208 are situated so as to be equally distanced from the respective references. Accordingly, the most balanced drive force can be obtained.

Third Embodiment

Figure 12A:
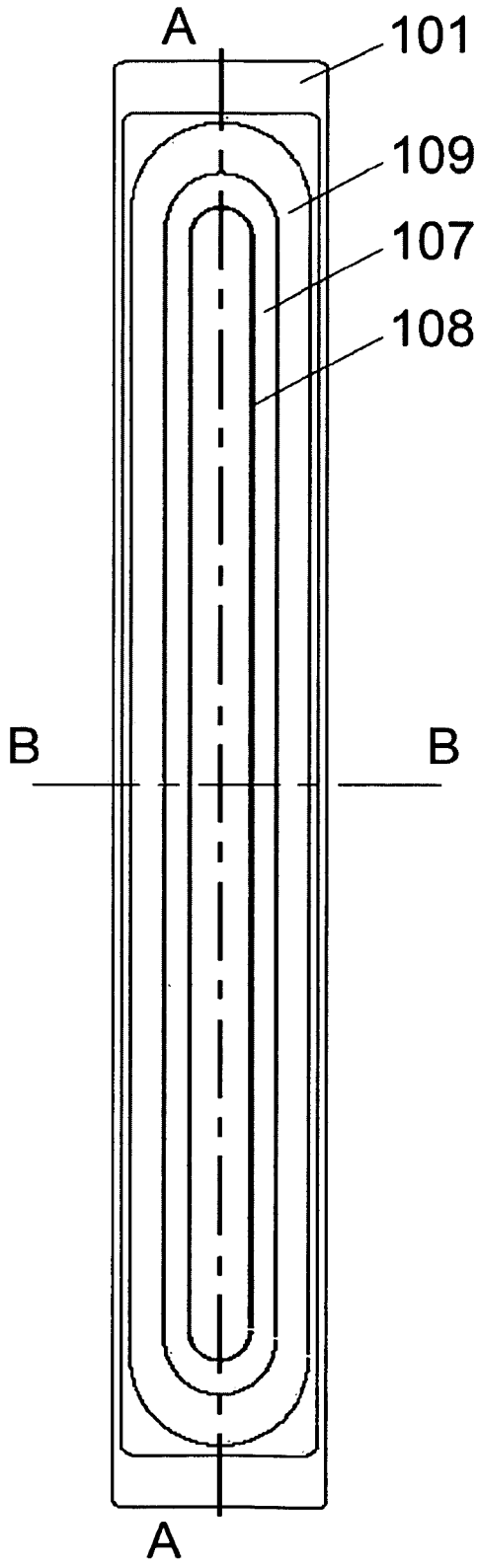
FIG. 12A is a front view of an electro-acoustical transducer according to a third embodiment.
Figure 12B:
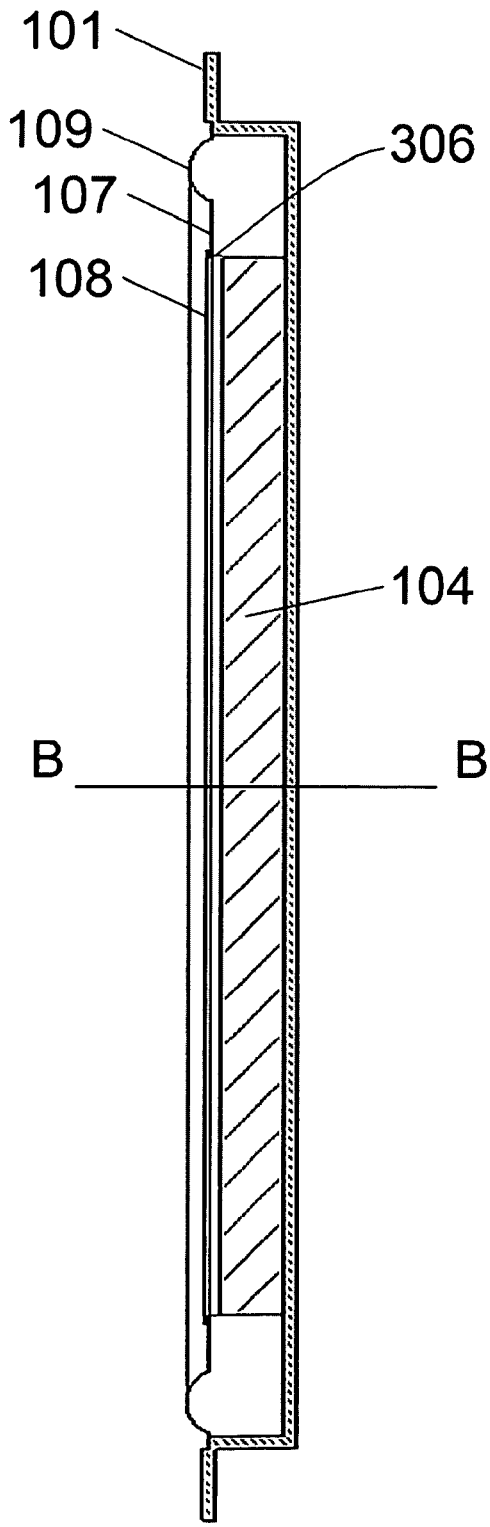
FIG. 12B is a cross sectional view of the electro-acoustical transducer as cut along a center line AA in a long side direction shown in FIG. 12A.
Figure 12C:
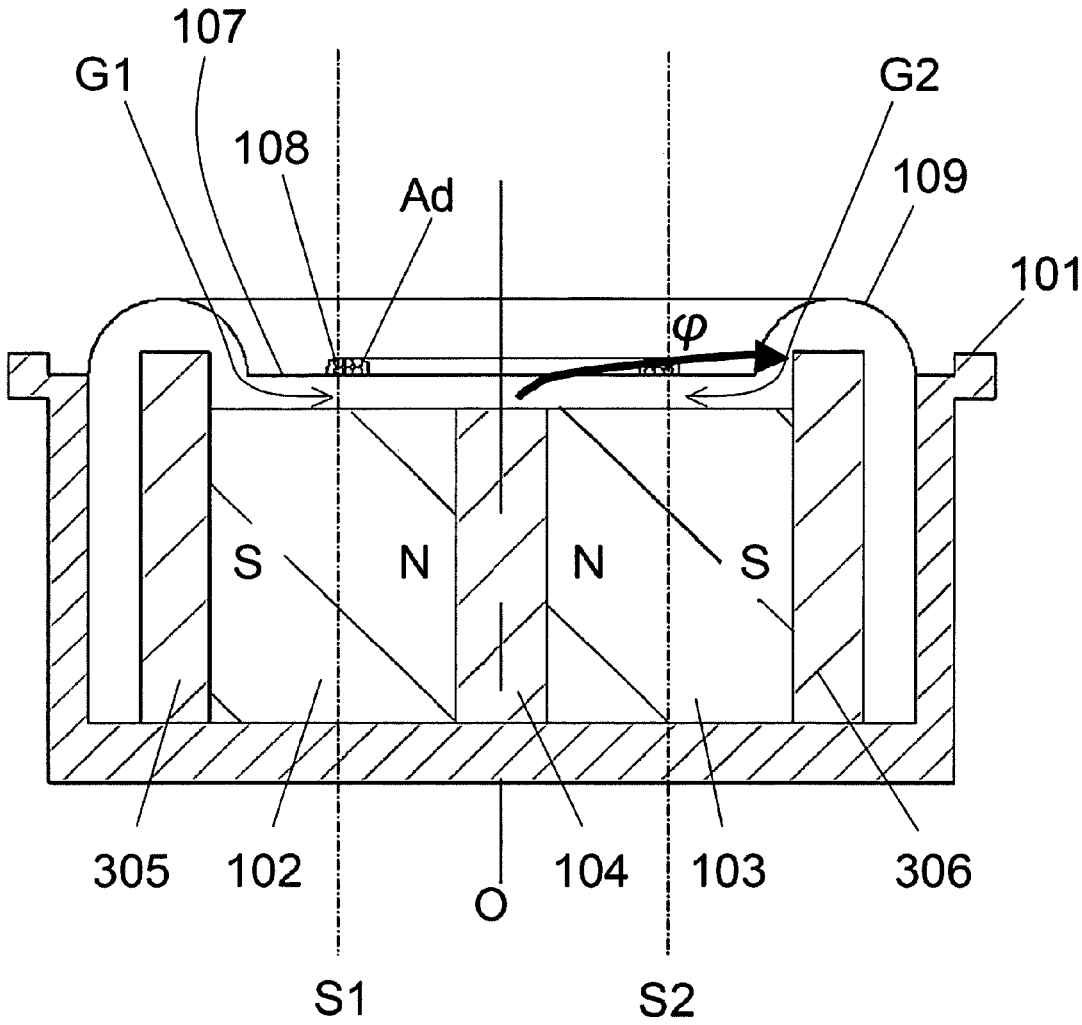
FIG. 12C is a cross sectional view of the electro-acoustical transducer as cut along a center line BB in a short side direction shown in FIG. 12A.

With reference to FIGS. 12A, 12B and 12C, a structure of an electro-acoustical transducer according to a third embodiment of the present invention will be described. FIGS. 12A, 12B and 12C are diagrams each showing an example of the electro-acoustical transducer according to the third embodiment. FIG. 12A is a front view. FIG. 12B is a cross sectional view of the electro-acoustical transducer as cut along a center line AA in a long side direction shown in FIG. 12A. FIG. 12C is a cross sectional view of the electro-acoustical transducer as cut along a center line BB in a short side direction shown in FIG. 12A.

As shown in FIGS. 12A, 12B and 12C, the electro-acoustical transducer according to the third embodiment includes the frame 101, the magnets 102 and 103, the plate 104, plates 305 and 306, the diaphragm 107, the coil 108, and the edge 109. The electro-acoustical transducer according to the present embodiment is different from the electro-acoustical transducer according to the first embodiment only in that the plates 105 and 106 in the first embodiment are replaced with the plates 305 and 306. The remaining component parts are denoted by the same reference characters as those in the first embodiment, and detail descriptions thereof will be omitted. Hereinafter different points will be mainly described.

Figure 13:
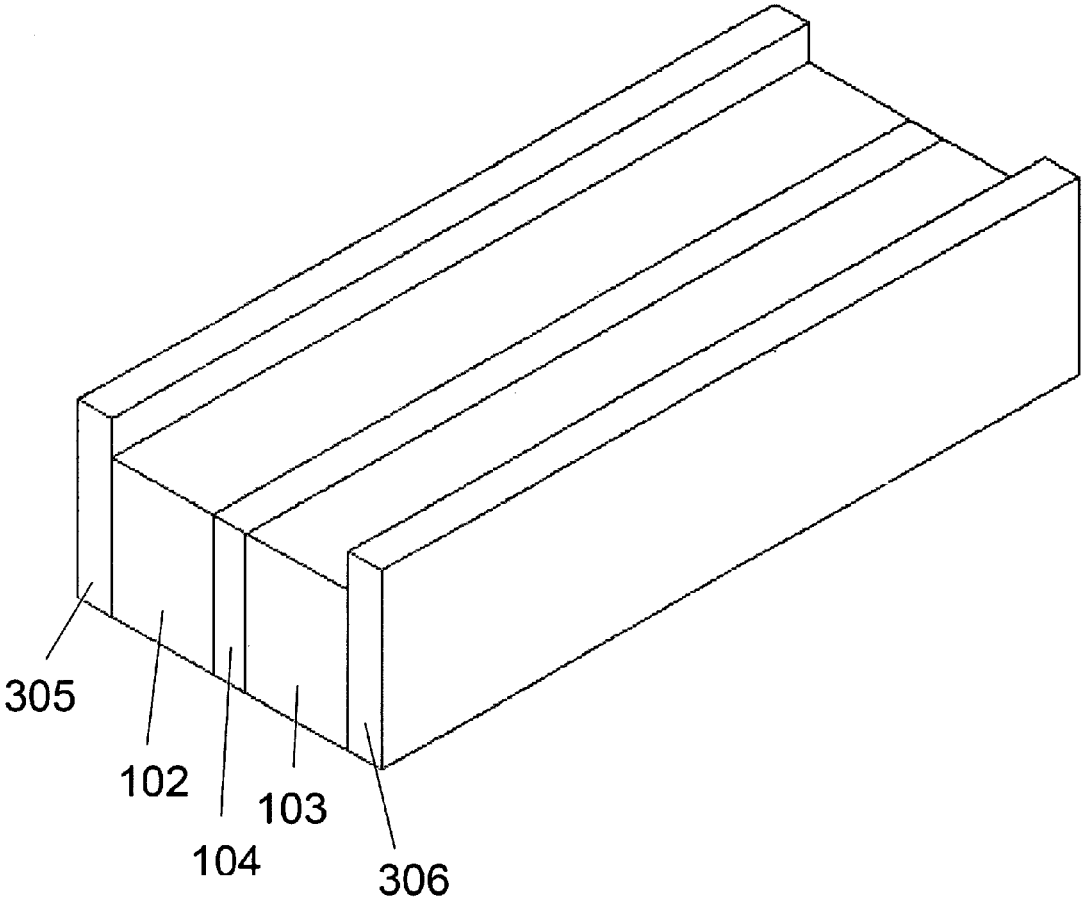
FIG. 13 is a perspective view of a magnetic circuit constituting the electro-acoustical transducer shown in FIG. 12C as viewed from an angle.

Each of the plates 305 and 306 is of a planar shape, and is made from a ferromagnetic material such as iron. The plate 305 is situated so as to be in contact with a pole face of the magnet 102, the pole face being opposite to that having contact with the plate 104. The plate 306 is situated so as to be in contact with a pole face of the magnet 103, the pole face being opposite to that having contact with the plate 104. The top surface of the plate 104 and the top surfaces of the magnets 102 and 103 are at a common height, and are situated on a common plane. On the other hand, the top surfaces of the plates 305 and 306 are higher than the top surfaces of the magnets 102 and 103, and are situated on a plane closer to the diaphragm 107. This structure is clear from a perspective view shown in FIG. 13. FIG. 13 is a perspective view of a magnetic circuit (composed of the magnets 102 and 103, the plate 104, and the plates 305 and 306), which constitutes the electro-acoustical transducer shown in FIG. 12C, as viewed from an angle. Further, the plates 305 and 306 are situated at positions below the edge 109, which is of an upward convex cross sectional shape, such that the top surfaces of the plates 305 and 306 face the edge 109. Further, in the short side direction of the diaphragm 107, a width of each of the plates 305 and 306 is smaller than a width of the edge 109. With this configuration, it is possible to prevent the edge 109 from having contact with the plates 305 and 306 when the diaphragm 107 vibrates.

Next, an operation of the electro-acoustical transducer according to the third embodiment will be described. When the AC electrical signal is supplied to the coil 108, the magnetic fluxes ϕ as shown in FIG. 12C are caused by the magnets 102 and 103, the plate 104, and the plates 305 and 306. Although FIG. 12C indicates that the magnetic fluxes ϕ are generated on only one side of the plate 104, the magnetic fluxes ϕ are generated on both sides of the plate 104. The magnet 102 and 103 are respectively polarized in directions opposite to each other. Therefore, the magnetic flux ϕ generated by the magnet 102 emanates from the N pole face, enters into the plate 104, and is radiated from the top surface of the plate 104 to the air gap thereabove. The magnetic flux ϕ radiated from the top surface of the plate 104 enters into the plate 305 through the air gap above the magnet 102. Accordingly, a magnetic field, which is composed of the magnetic flux perpendicular to the vibration direction (an up-down direction in FIG. 12C), is formed above the magnet 102, and the magnetic gap G1 is formed above the magnet 102. On the other hand, the magnetic flux ϕ generated by the magnet 103 emanates from the N pole face, enters into the plate 104, and then is radiated from the top surface of the plate 104 to the air gap thereabove. The magnetic flux ϕ radiated from the top surface of the plate 104 enters into the plate 306 through the air gap above the magnet 103. Accordingly, the magnetic field, which is composed of the magnetic flux perpendicular to the vibration direction, is formed above the magnet 103, and the magnetic gap G2 is formed above the magnet 103.

Figure 14:
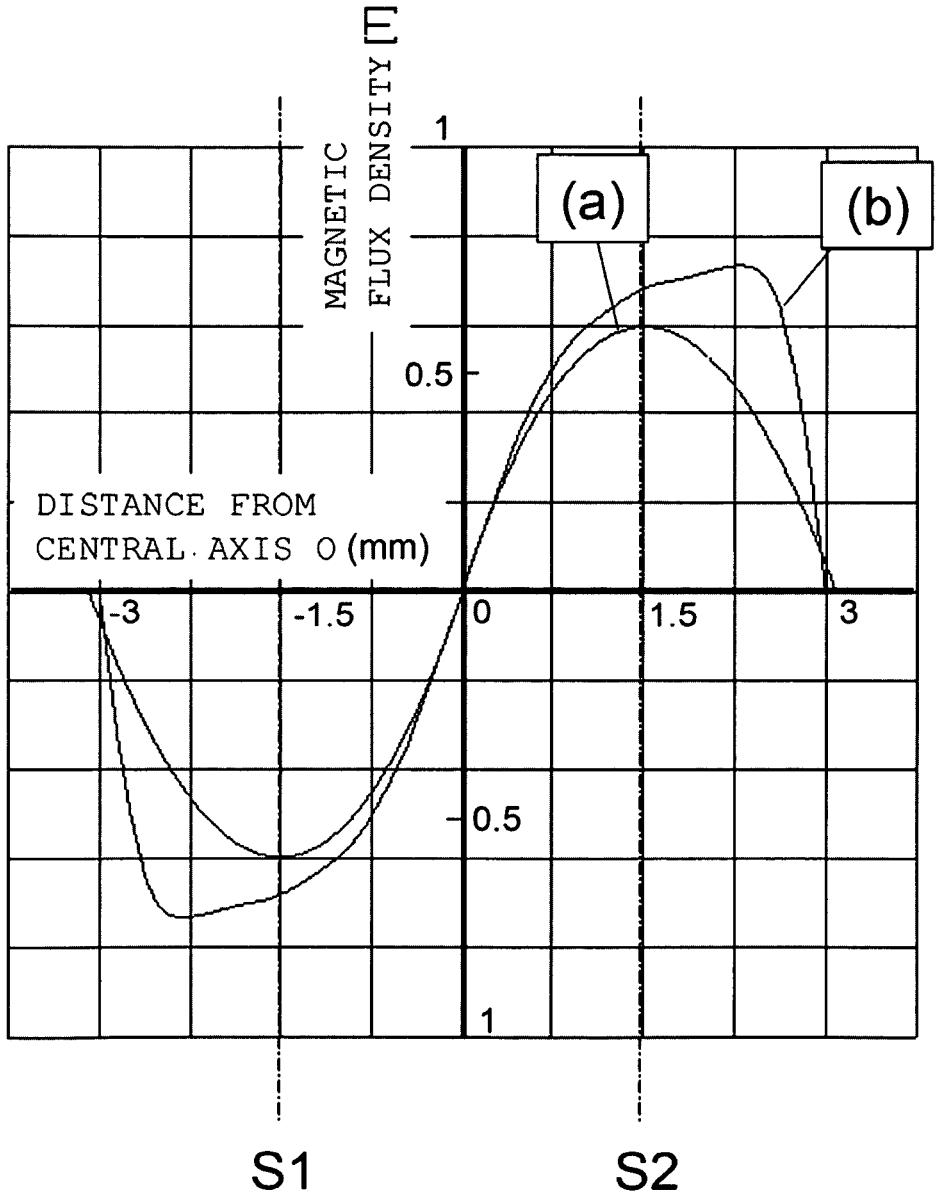
FIG. 14 is a diagram showing a change in the magnetic flux density distribution in the case where top surfaces of plates 305 and 306 are higher by 1.0 mm than top surfaces of the magnets 102 and 103.

The top surfaces of the plates 305 and 306 are higher than the top surfaces of the magnets 102 and 103, and are situated closer to the diaphragm 107. Therefore, the magnetic fluxes ϕ are induced to the higher top surface of the plates 305 and 306, respectively, and the magnetic fluxes ϕ passing through the coil 108 are increased. In the structure shown in FIG. 12C, the coil 108 is firmly fixed on the top surface of the diaphragm 107. Therefore, when the top surfaces of the plates 305 and 306 are higher than the diaphragm 107, the magnetic fluxes passing through the coil 108 are likely to be increased most. FIG. 14 shows a change in the magnetic flux density distribution in the case where the top surfaces of the plates 305 and 306 are higher by 1.0 mm than the top surfaces of the magnets 102 and 103.

As shown in FIG. 14, the vertical-axis indicates a magnetic flux density, and the horizontal-axis indicates a distance from the central axis O in the short side direction of the diaphragm 107. The right side of the central axis O shown in FIG. 12C is a positive direction of the horizontal axis. Further, in FIG. 14, a width of the plate 104 in the short side direction is 1 mm, a width of each of the magnets 102 and 103 in the short side direction is 2 mm, a width of each of the plates 305 and 306 in the short side direction is 1 mm, and a width of each of the magnets 102 and 103 in the vibration direction of the diaphragm 107 is 8 mm. A graph (a) shown in FIG. 14 indicates a magnetic flux density distribution in the case where the top surfaces of the plates 305 and 306 are as high as the top surfaces of the magnets 102 and 103. A graph (b) shown in FIG. 14 indicates a magnetic flux density distribution in the case where the top surfaces of the plates 305 and 306 are higher by 1.0 mm than the top surfaces of the magnets 102 and 103.

As with the first embodiment, the magnetic flux density indicated by the graph (a) reaches its maximum value at the positions of the width central axes S1 and S2. On the other hand, the magnetic flux density indicated by the graph (b) is generally higher than that indicated by the graph (a). This is because the magnetic fluxes ϕ are induced to the higher top surfaces of the plates 305 and 306. In this manner, when the top surfaces of the plate 305 and 306 are higher than the top surfaces of the magnets 102 and 103, the magnetic flux density is increased. Further, according to the graph (b), the magnetic flux density increases when the distance moves from the positions of the width central axes S1 and S2 to the positions above the plates 305 and 306, respectively, compared to the graph (a). Therefore, in order to obtain the drive force most efficiently, the long sides of the coil 108 may be situated at positions which are deviated from the positions of the width central axes S1 and S2 toward the positions above the plates 305 and 306.

When an AC electrical signal is supplied to the coil 108, the drive force is generated so as to be proportional to the magnetic flux which is perpendicular to the direction of the current flowing through the coil 108 and is also perpendicular to the vibration direction of the diaphragm 107. With the drive force, the diaphragm 107 bonded on the coil 108 vibrates, whereby the vibration is emitted as a sound.

As above described, in the electro-acoustical transducer according to the present embodiment, the top surfaces of the plates 305 and 306 are higher than the top surfaces of the magnets 102 and 103, and are located on a plane closer to the diaphragm 107. Accordingly, compared to the first embodiment, the drive force obtained in the coil 108 is increased, and consequently it is possible to further increase the reproduced sound pressure level in the ultra-high frequency band.

Fourth Embodiment

Figure 15A:
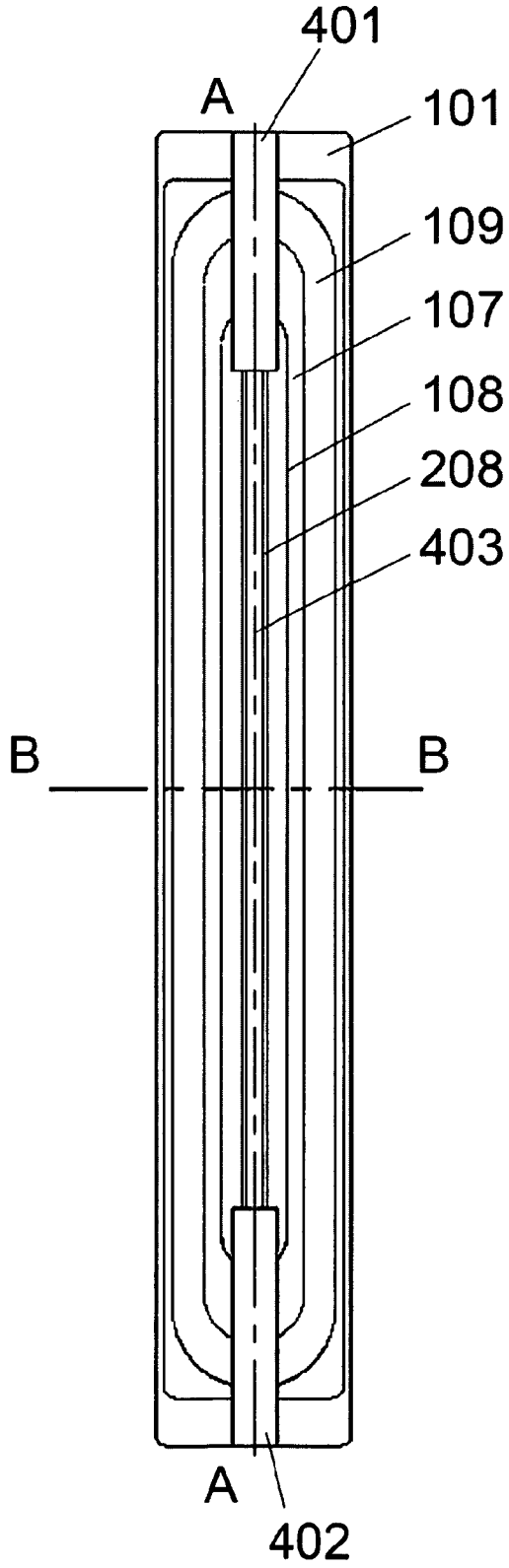
FIG. 15A is a front view of an electro-acoustical transducer according to a fourth embodiment.
Figure 15B:
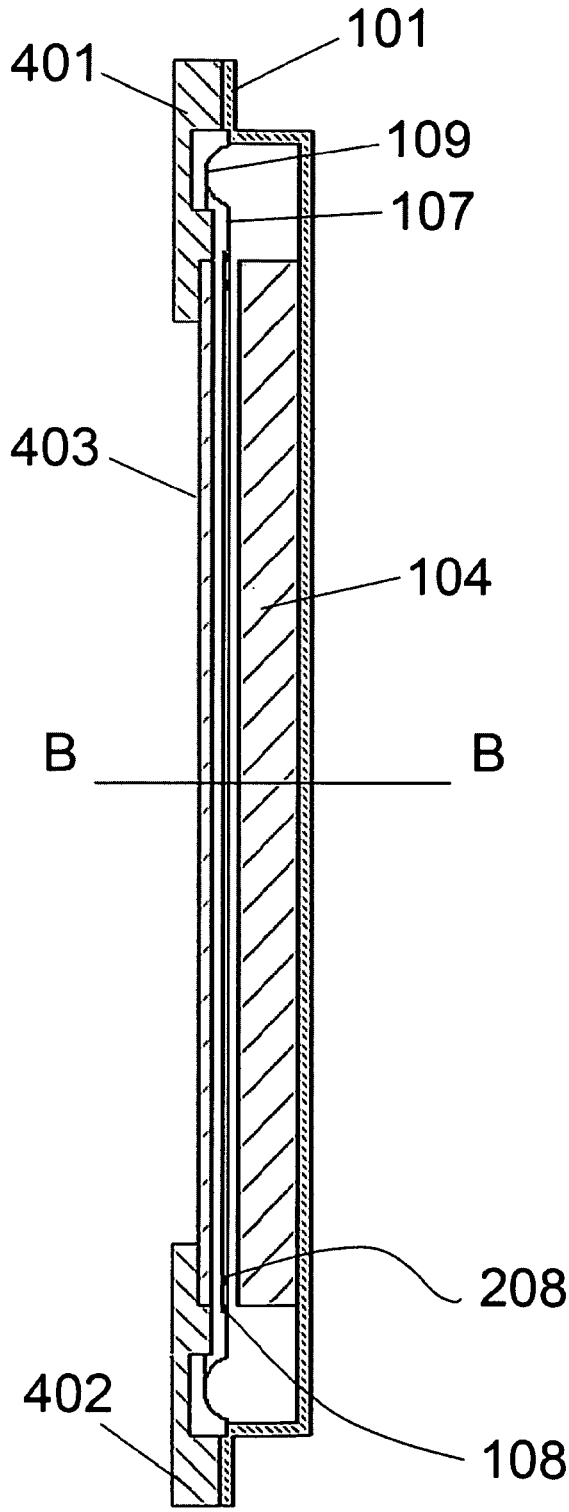
FIG. 15B is a cross sectional view of the electro-acoustical transducer as cut along a center line AA in a long side direction shown in FIG. 15A.
Figure 15C:
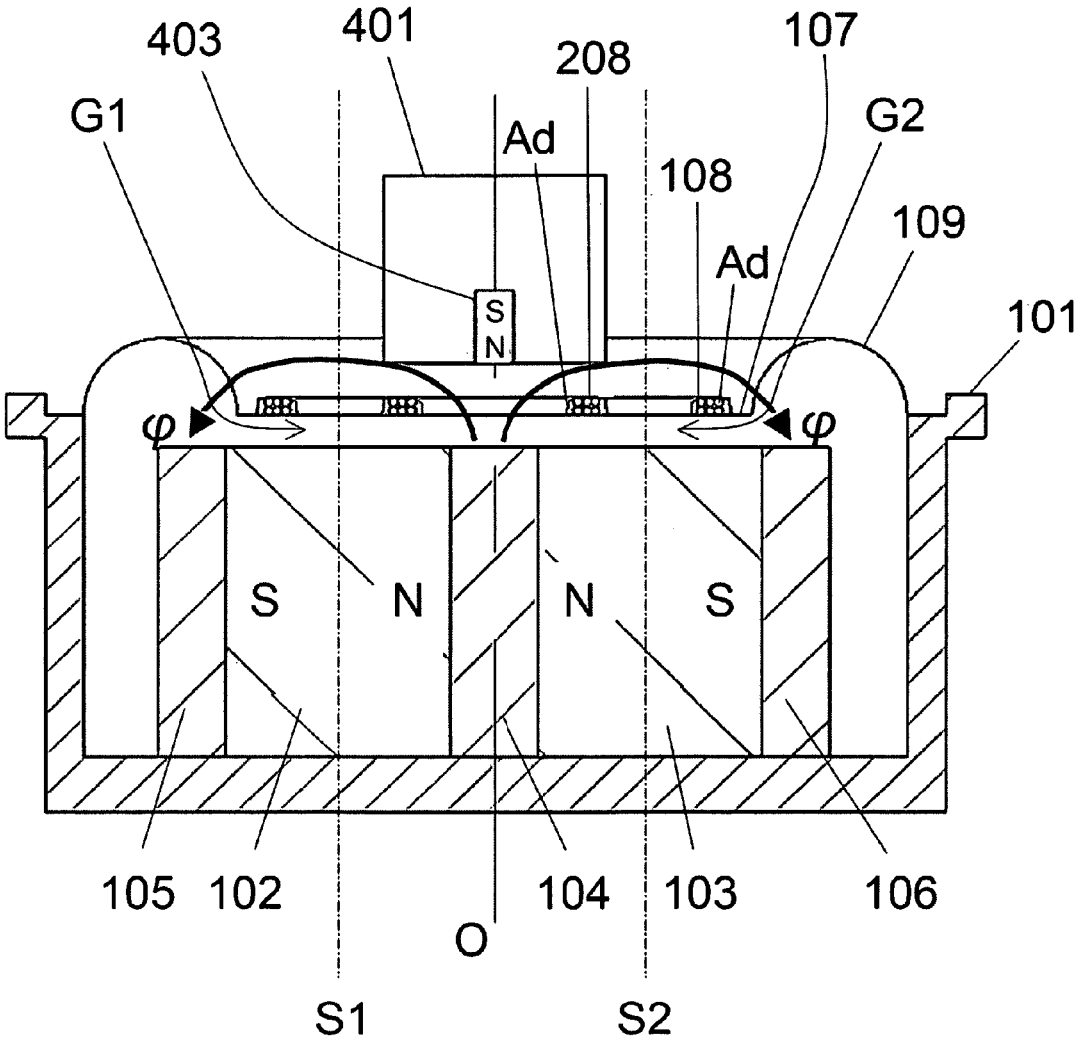
FIG. 15C is a cross sectional view of the electro-acoustical transducer as cut along a center line BB in a short side direction shown in FIG. 15A.

With reference to FIGS. 15A, 15B and 15C, a structure of an electro-acoustical transducer according to a fourth embodiment of the present invention will be described. FIGS. 15A, 15B and 15C are diagram each showing an example of the electro-acoustical transducer according to the fourth embodiment. FIG. 15A is a front view. FIG. 15B is a cross sectional view of the electro-acoustical transducer as cut along a center line AA in a long side direction shown in FIG. 15A. FIG. 15C is a cross sectional view of the electro-acoustical transducer as cut along a center line BB in a short side direction shown in FIG. 15A.

As shown in FIGS. 15A, 15B and 15C, the electro-acoustical transducer according to the fourth embodiment includes the frame 101, the magnets 102 and 103, the plates 104 to 106, the diaphragm 107, the coils 108 and 208, the edge 109, supporting materials 401 and 402, and a magnet 403. The electro-acoustical transducer according to the present embodiment is different from the electro-acoustical transducer according to the second embodiment in that the supporting materials 401 and 402 and the magnet 403 are additionally included. The remaining component parts are denoted by the same reference characters as those according to the second embodiment, and detail descriptions thereof will be omitted. Hereinafter, different points will be mainly described.

The magnet 403 is of a parallelepiped shape, and is made from a neodymium magnet having an energy product of 44 MGOe, for example. The magnet 403 is situated above the diaphragm 107 such that a central portion of the magnet 403 corresponds to the central axis O of the diaphragm 107 in the short side direction. The magnet 403 is situated such that long sides thereof are in parallel with the long sides of the diaphragm 107. Respective extremities of the magnets 403 in the long side direction are firmly fixed on the supporting materials 401 and 402. The supporting materials 401 and 402 are firmly fixed on the frame 101. The magnet 403 is polarized in the vibration direction (an up-down direction in FIG. 15C) of the diaphragm 107. The polarity of a pole face of the magnet 403 facing the top surface of the diaphragm 107 is the same as the polarity of respective pole surfaces of the magnets 102 and 103 having contact with the plate 104. In an example shown in FIG. 15C, the polarity of the pole face of the magnet 403 facing the top surface of the diaphragm 107 is an N-type, and the polarity of each the pole faces of the magnet 102 and 103 having contact with the plate 104 is also the N-type.

The long sides of the coils 108 and 208 are situated at positions to suppress both of the first resonant mode and the second resonant mode occurring on the diaphragm 107 in the short side direction. Further, when the respective width central axes S1 and S2 of the magnets 102 and 103 are set as the references, the respective long sides of the coils 108 and 208 are situated so as to be equally distanced from the respective references.

Figure 16:
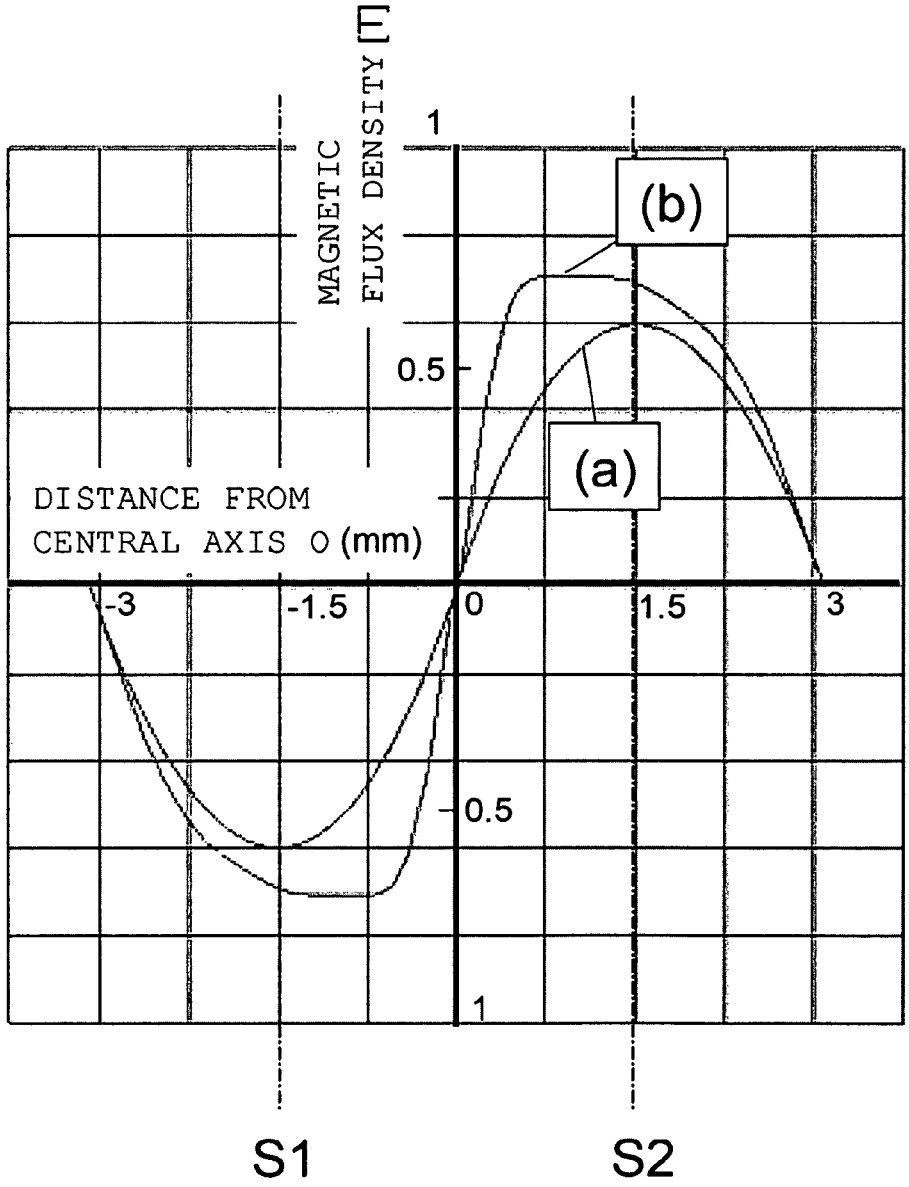
FIG. 16 is a diagram showing a change in the magnetic flux density distribution in the case where a magnet 403 is situated.

Next, an operation of the electro-acoustical transducer according to the fourth embodiment will be described. When the AC electrical signal is not supplied to the coils 108 and 208, the magnetic fluxes ϕ shown in FIG. 15C are caused by the magnets 102, 103 and 403, and the plates 104 to 106. The magnets 102 and 103 are polarized in directions opposite to each other. Accordingly, the magnetic flux ϕ caused by the magnet 102 emanates from the N pole face, enters into the plate 104, and is radiated from the top surface of the plate 104 to the air gap thereabove. A lower surface of the magnet 403 constitutes a north pole. Therefore, the magnetic flux ϕ radiated from the top surface of the plate 104 forcedly moves in the horizontal direction. The magnetic flux ϕ moving in the horizontal direction enters into the plate 105 through the air gap above the magnet 102. Accordingly, a magnetic field which is greater than that of the second embodiment and which is composed of the magnetic flux perpendicular to the vibration direction (an up-down direction in FIG. 15C) is formed above the magnet 102, and the magnetic gap G1 is formed above the magnet 102. The magnetic flux ϕ caused by the magnet 103, on the other hand, emanates from the north pole face, enters into the plate 104, and is radiated from the top surface of the plate 104 to the air gap thereabove. The lower surface of the magnet 403 constitutes the north pole, and thus the magnetic flux ϕ radiated from the top surface of the plate 104 forcedly moves in the horizontal direction. The magnetic flux ϕ moving in the horizontal direction enters into the plate 106 through the air gap above the magnet 103. Accordingly, a magnetic field which is greater than that of the second embodiment and which is composed of the magnetic flux perpendicular to the vibration direction (the up-down direction in FIG. 15C) is formed above the magnet 103, and the magnetic gap G2 is formed above the magnet 103. The magnet 403 is arranged in this manner, whereby it is possible to increase the magnetic fluxes perpendicular to the vibration direction, compared to the second embodiment. FIG. 16 shows a change in the magnetic flux density distribution in the case where the magnet 403 is situated.

In FIG. 16, the vertical-axis indicates the magnetic flux density, and the horizontal-axis indicates a distance from the central axis O in the short side direction of the diaphragm 107. The right side of the central axis O shown in FIG. 15C indicates a positive direction of the horizontal axis. In FIG. 16, the width of each of the plates 104 to 106 in the short side direction is 1 mm, the width of each of the magnets 102 and 103 in the short side direction is 2 mm, and the width of each of the magnets 102 and 103 in the vibration direction of the diaphragm 107 is 8 mm. A graph (a) shown in FIG. 16 indicates a magnetic flux density distribution in the case where the magnet 403 is not situated. A graph (b) shown in FIG. 16 indicates a magnetic flux density distribution in the case where the magnet 4Q3 is situated.

As with the first embodiment, the magnetic flux density indicated by the graph (a) reaches its maximum value at positions of the width central axes S1 and S2. On the other hand, the magnetic flux density indicated by the graph (b) is generally higher than that indicated by the graph (a). This is because the magnetic flux ϕ radiated from the top surface of the plate 104 is forced by the magnet 403 to move in the horizontal direction. The magnet 403 is situated in this manner, whereby it is possible to increase the magnetic flux density. The graph (b) indicates that the closer to the central axis O the distance is, the greater the magnetic flux density is.

When the AC electrical signal is supplied to the coils 108 and 208, the drive force is generated so as to be proportional to the magnetic flux which is perpendicular to the current direction flowing through the coils 108 and 208, and is also perpendicular to the vibration direction of the diaphragm 107. With the drive force, the diaphragm 107 bonded on the coils 108 and 208 vibrates, and the vibration is emitted as a sound.

The long sides of the coils 108 and 208 are situated in the positions to suppress both of the first resonant mode and the second resonant mode occurring on the diaphragm 107 in the short side direction. Accordingly, it is possible to suppress the first resonant mode and the second resonant mode occurring on the diaphragm 107 in the short side direction, whereby it is possible to flatten the sound-pressure frequency characteristic up to the frequency where the third resonant mode occurs.

As above described, in the electro-acoustical transducer according to the present embodiment, the magnet 403 is additionally included as compared to the second embodiment. Accordingly, it is possible to increase the magnetic flux perpendicular to the vibration direction as compared to the case of the second embodiment, and also possible to increase the reproduced sound pressure level in the ultra-high frequency band.

Figure 17:
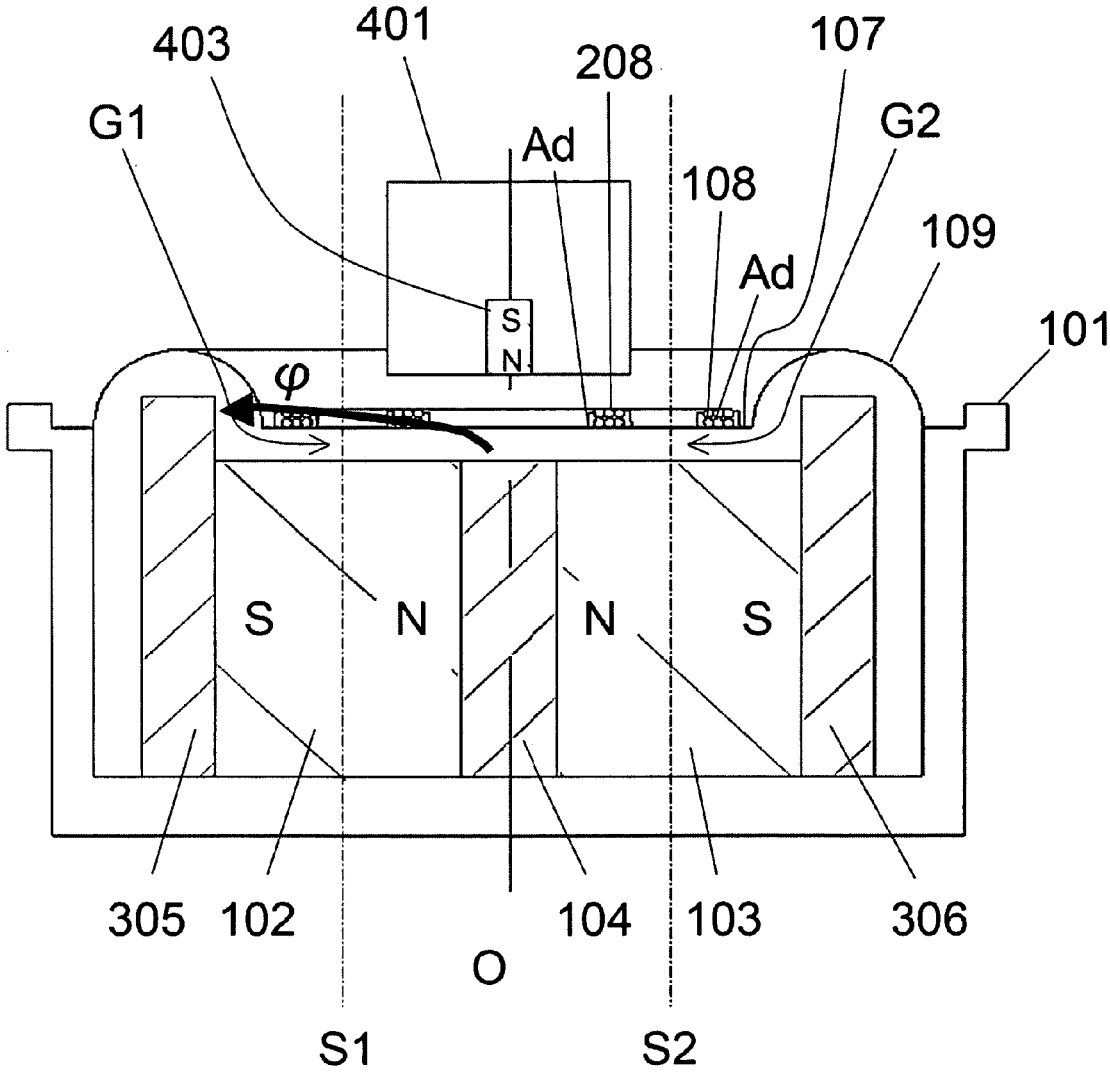
FIG. 17 is a tectonic profile of the electro-acoustical transducer in the case where the plates 105 and 106 shown in FIG. 15C are replaced with the plates 305 and 306.
Figure 18:
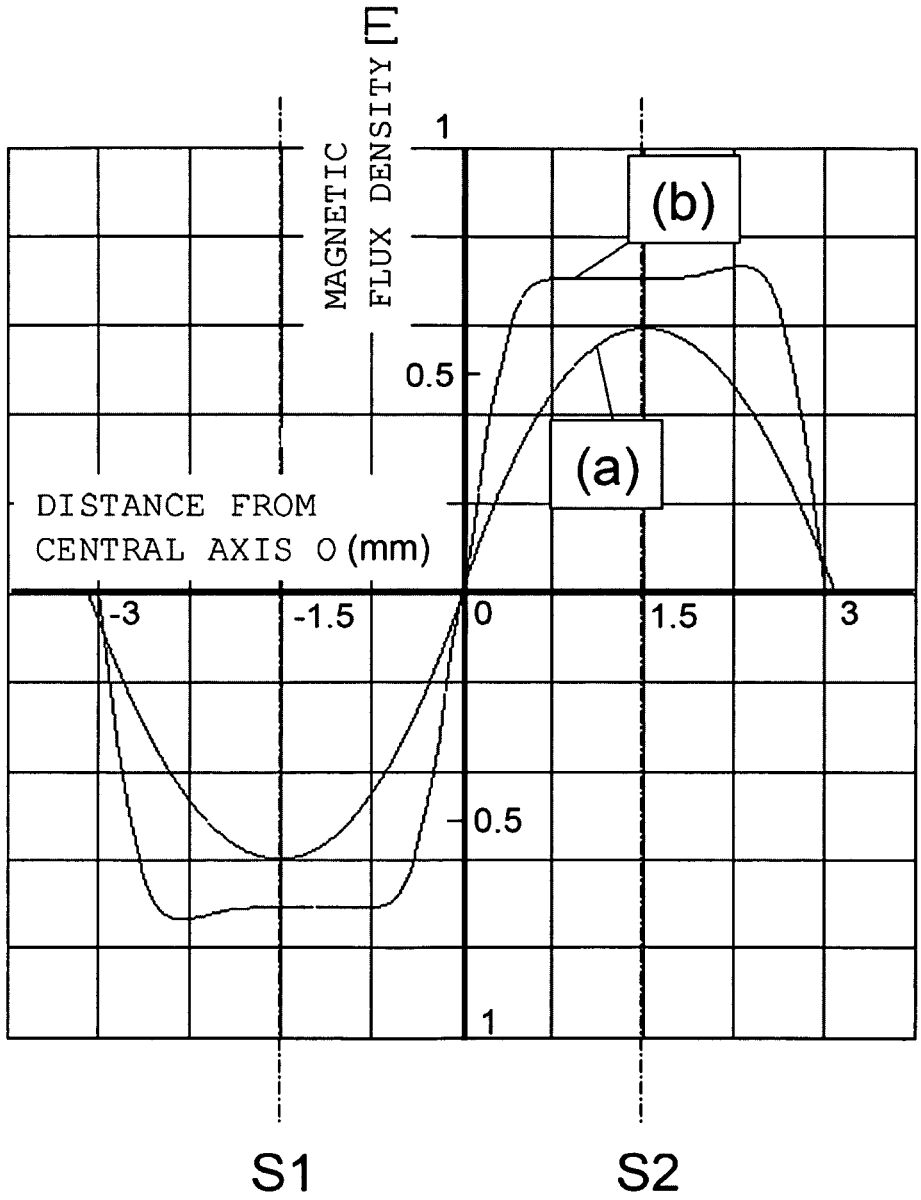
FIG. 18 is a diagram showing a change in the magnetic flux density distribution in the case where top surfaces of the plates 305 and 306 are higher by 1.0 mm than the top surfaces of the magnets 102 and 103.

In the present embodiment, as shown in FIG. 17, the plates 105 and 106 may be replaced with the plates 305 and 306. FIG. 17 is a tectonic profile of the electro-acoustical transducer in the case where the plates 105 and 106 shown in FIG. 15 are replaced with the plates 305 and 306. The plates 305 and 306 are the same as those shown in FIG. 12. The top surfaces of the plates 305 and 306 are higher than the top surfaces of the magnets 102 and 103, and are situated in a plane closer to the diaphragm 107. FIG. 18 shows a change in the magnetic flux density distribution in the case where the top surfaces of the plates 305 and 306 are higher by 1.0 mm than the top surfaces of the magnets 102 and 103.

In FIG. 18, the vertical-axis indicates a magnetic flux density, and the horizontal-axis indicates a distance from the central axis O in the short side direction of the diaphragm 107. The right side of the central axis O shown in FIG. 17 indicates a positive direction of the horizontal axis. In FIG. 18, the width of the plate 104 in the short side direction is 1 mm, the width of each of the magnets 102 and 103 in the short side direction is 2 mm, the width of each of the plates 305 and 306 in the short side direction is 1 mm, and the width of each of the magnets 102 and 103 in the vibration direction of the diaphragm 107 is 8 mm. A graph (a) shown in FIG. 18 is the same as the graph (a) shown in FIG. 16. A graph (b) shown in FIG. 18 indicates a magnetic flux density distribution when the top surfaces of the plates 305 and 306 are higher by 1.0 mm than the top surfaces of the magnets 102 and 103.

As with the first embodiment, the magnetic flux density indicated by the graph (a) reaches its maximum value at positions of the width central axes S1 and S2. On the other hand, the magnetic flux density indicated by the graph (b) is generally higher than that indicated by the graph (a). Specifically, in the vicinity of the central axis O, the magnetic flux $\phi$ radiated from the top surface of the plate 104 is forced by the magnet 403 to move in the horizontal direction, and thus the magnetic flux density increases. On the other hand, in the vicinities of the plates 305 and 306, the magnetic fluxes $\phi$ are induced to the higher top surfaces of the plates 305 and 306, and thus the magnetic flux density increases. In this manner, the top surfaces of the plates 305 and 306 are higher than the top surfaces of the magnets 102 and 103, and thus regardless of the distance from the central axis O, it is possible to increase the magnetic flux density in a uniformed manner.

In order to raise an operating point of the magnet 403, a yoke which is made from the ferromagnetic material such as iron may be provided on the top surface of the magnet 403. In this case, in order to prevent sound emission to an upper side of the diaphragm 107, it is preferable that a width of the yoke in the short side direction of the diaphragm 107 is equal to or less than the width of the magnet 403.

Figure 19:
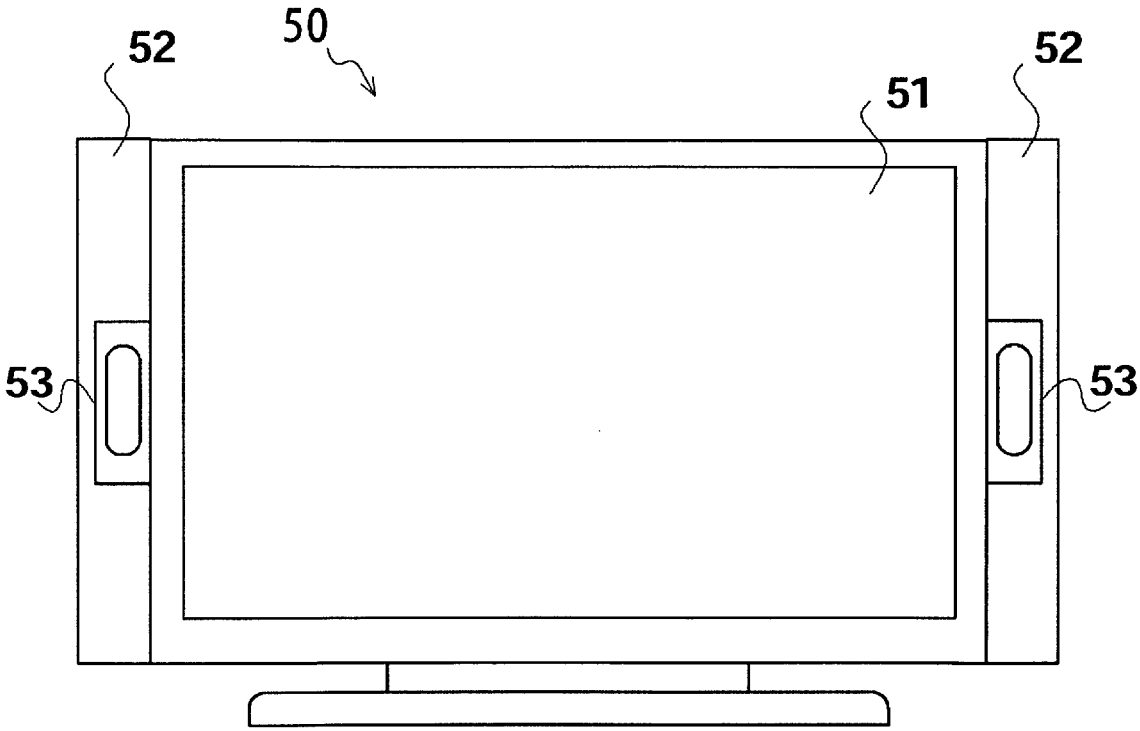
FIG. 19 is a diagram showing a flat-screen television.

It is possible to mount the electro-acoustical transducer according to each of the first to fourth embodiments to an audio-visual apparatus such as a personal computer and a television. The electro-acoustical transducer according to each of the first to fourth embodiments is situated inside a housing of the audio-visual apparatus. Hereinafter, an exemplary case will be described where the electro-acoustical transducer according to the first embodiment is mounted in a flat-screen television, which is an audio-visual apparatus. FIG. 19 is a diagram showing the flat-screen television.

As shown in FIG. 19, the flat-screen television 50 includes a display section 51, equipment housings 52 and the electro-acoustical transducers 53. The display section 51 is configured with a plasma display panel or a liquid crystal display panel, and displays images. On both sides of the display section 51, the equipment housings 52 to accommodate the electro-acoustical transducers 53 are situated. Each of the equipment housings 52 has a dust-proof net attached to a position where each of the electro-acoustical transducers 53 are mounted, and the dust-proof net has sound holes. Alternatively, the sound holes are formed on the equipment housings 52. Each of the electro-acoustical transducers 53 has the same structure as the electro-acoustical transducer according to the first embodiment, and is situated such that a sound emitting surface thereof faces a television viewer. In FIG. 19, each of the electro-acoustical transducers 53 is mounted in each of the equipment housings 52, but may be mounted in an inside of another equipment housing. For example, the electro-acoustical transducers may be mounted on the substrate inside the flat-screen television 50.

Next, an operation of the flat-screen television as shown in FIG. 19 will be described. A radio wave outputted from a base station is received by an antenna. The radio wave received by the antenna is inputted to the flat-screen television 50, and converted by an electrical circuit (not shown) inside the flat-screen television 50 into a video signal and an audio signal. The video signal is displayed on the display section 51, and the audio signal is emitted from the electro-acoustical transducers 53 as a sound.

In the flat-screen television 50, in order to increase a horizontal width of the display section 51 relative to a total horizontal width of the flat-screen television 50, that is, in order to realize a large-size screen, a horizontal width of each of the equipment housings 52 is made as small as possible. Accordingly, the electro-acoustical transducers 53 to be mounted in the equipment housings 52 need to be narrow in horizontal width (width in the short side direction). The electro-acoustical transducers 53 according to the present embodiment are narrow in horizontal width, and are also capable of increasing the magnetic fluxes in the direction perpendicular to the vibration direction of the diaphragm efficiently. Accordingly, it is possible to improve the reproduced sound pressure level. As a result, it is possible to realize an improved sound reproduction in the ultra-high frequency band, and the electro-acoustical transducers 53 are useful for the audio-visual apparatus such as the flat-screen television 50 which is being improved so as to realize the large-size screen.

Figure 20:
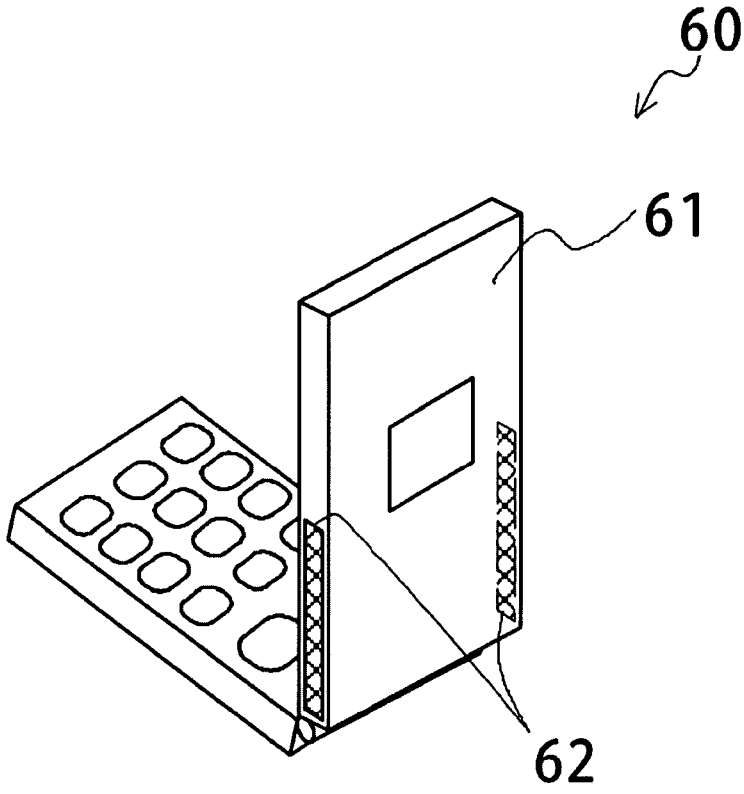
FIG. 20 is a diagram showing a mobile phone.

The electro-acoustical transducer according to each of the above-described first to fourth embodiments can be mounted in a portable terminal apparatus such as a mobile phone and a PDA. The electro-acoustical transducer according to each of the first to fourth embodiments is mounted inside the equipment housing provided to the portable terminal apparatus. Hereinafter, as a specific case, a case will be described where the electro-acoustical transducer according to the first embodiment is mounted in the mobile phone, which is the portable terminal apparatus. FIG. 20 is a diagram showing the mobile phone.

As shown in FIG. 20, the mobile phone 60 includes an equipment housing 61 and electro-acoustical transducers 62. Each of the electro-acoustical transducers 62 has the same structure as the electro-acoustical transducer according to the first embodiment, and is mounted inside the equipment housing 61.

Next, an operation of the mobile phone 60 shown in FIG. 20 will be described briefly. For example, when an antenna (not shown) of the mobile phone receives a radio wave, a sound signal for notifying of a reception is generated by an electrical circuit (not shown) located inside the mobile phone 60. The generated sound signal is emitted from the electro-acoustical transducers 62 as a sound.

As to the mobile phone 60, a thin mobile phone is desired, and thus a thickness of the equipment housing 61 is made as thin as possible. Accordingly, the electro-acoustical transducers 62 mounted in the equipment housing 61 need to be narrow in the horizontal width (in width in the short side direction). The electro-acoustical transducers 62 are narrow in the horizontal width, and are capable of increasing the magnetic fluxes in the direction perpendicular to the vibration direction of the diaphragm. Therefore, it is possible to improve the reproduced sound pressure level. As a result, it is possible to realize an improved sound reproduction in the ultra-high frequency band, and accordingly, the electro-acoustical transducer 62 are useful for the portable terminal apparatus such as the mobile phone 60 which is required to be thinner.

Figure 21:
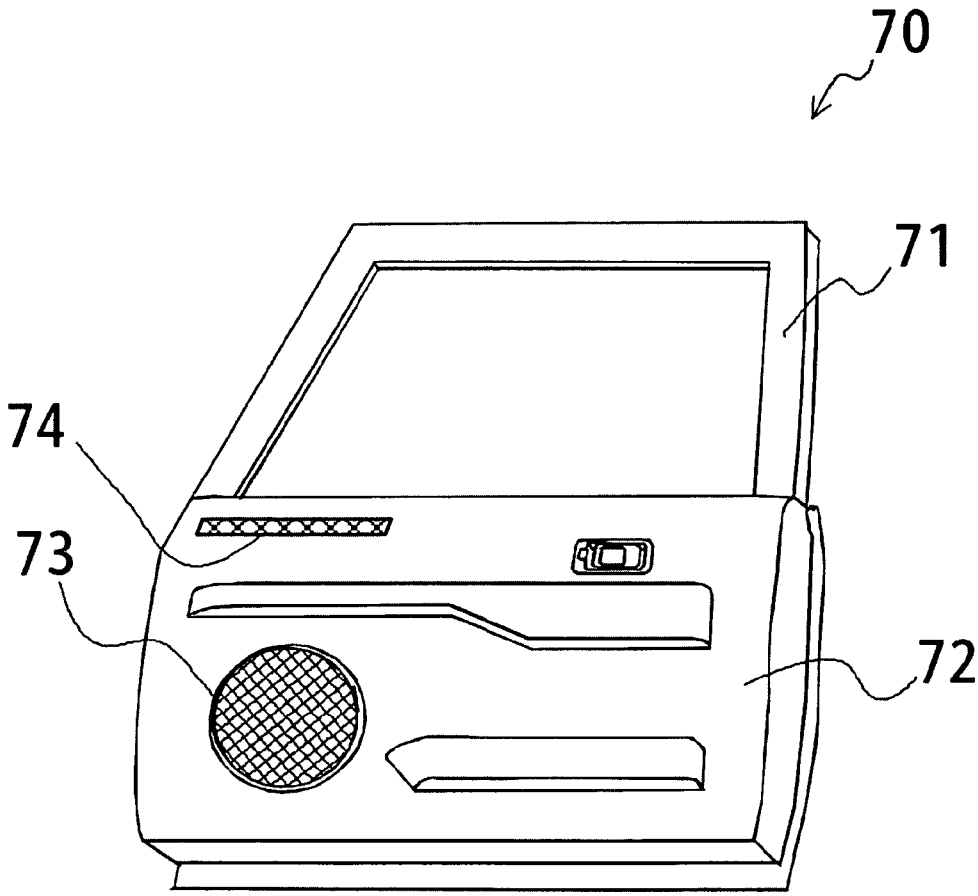
FIG. 21 is a diagram showing a door of a vehicle.
Figure 22A:
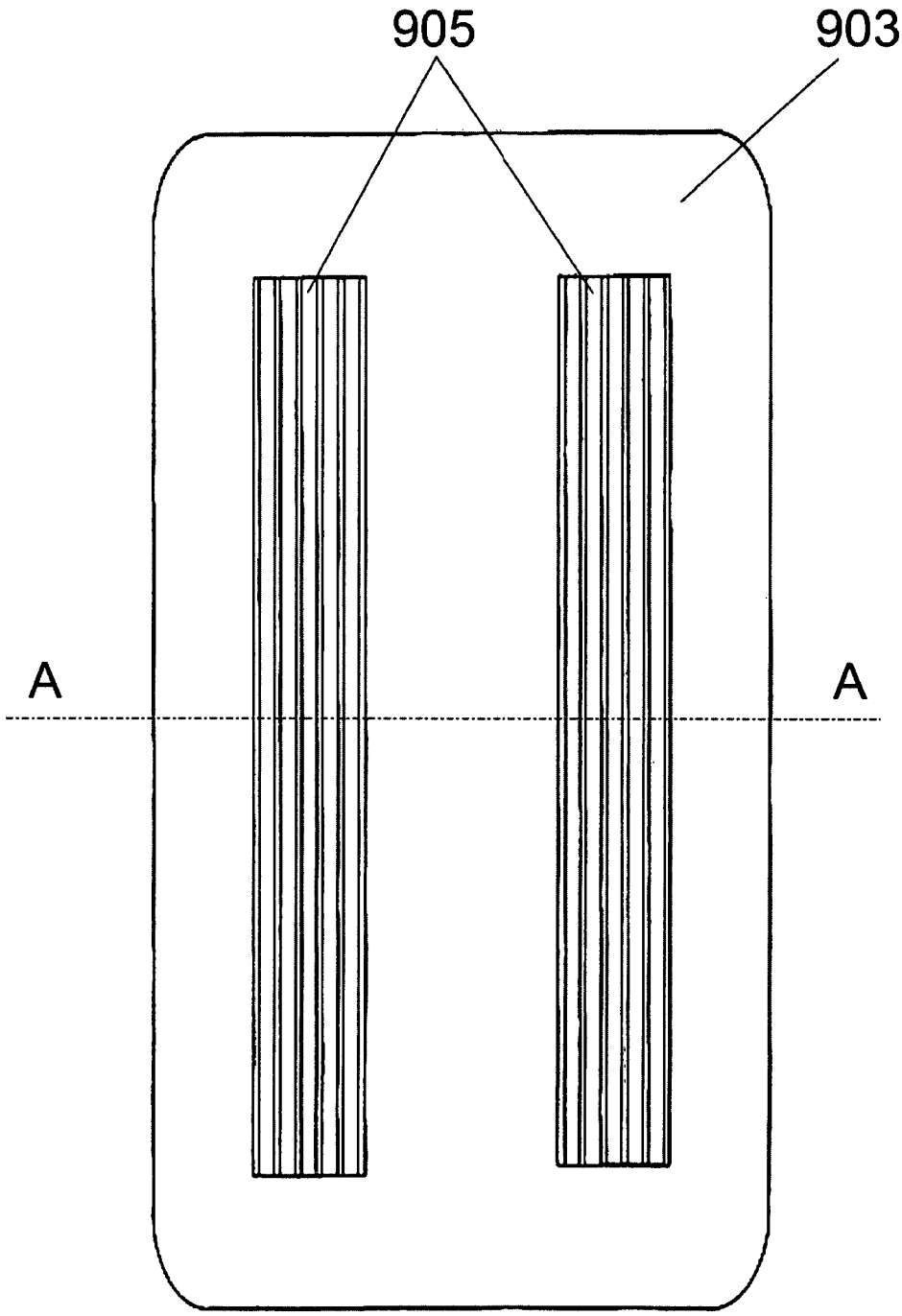
Fig 22A PRIOR ART
FIG. 22A is a front view of a conventional electro-acoustical transducer.
Figure 22B:
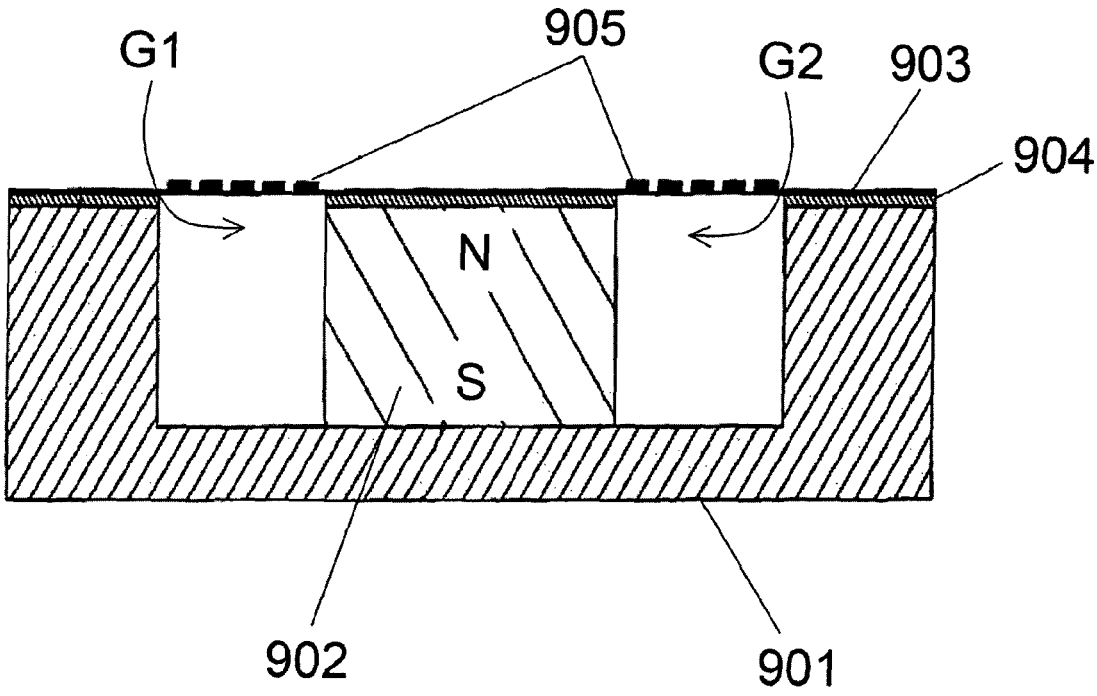
Fig 22B PRIOR ART
FIG. 22B is a cross sectional view of the electro-acoustical transducer as cut along a center line AA in a short side direction shown in FIG. 22.

The electro-acoustical transducer according to each of the first to fourth embodiments can be mounted in a vehicle such as an automobile, as an in-car electro-acoustical transducer. The electro-acoustical transducer according to each of the first to fourth embodiments is mounted inside the vehicle body. Hereinafter, a case will be described where the electro-acoustical transducer according to the first embodiment is mounted in a door of an automobile. FIG. 21 is a diagram showing the door of the automobile.

As shown in FIG. 21, the door 70 of the automobile includes a widow section 71, a door body 72, a bass electro-acoustical transducer 73, and a treble electro-acoustical transducer 74. The bass electro-acoustical transducer 73 is an electro-acoustical transducer for emitting a bass sound. The treble electro-acoustical transducer 74 is an electro-acoustical transducer for emitting a treble sound. Both of the transducers have the same structure as the electro-acoustical transducer according to the first embodiment. The bass electro-acoustical transducer 73 and the treble electro-acoustical transducer 74 are mounted inside the door body 72. The treble electro-acoustical transducer 74 is capable of efficiently increasing the magnetic flux in the direction perpendicular to the vibration direction of the diaphragm, and also capable of improving the reproduced sound pressure level. As a result, it is possible to provide an improved in-car listening environment in which an improved sound reproduction in the ultra-high frequency band can be realized.

While the invention has been described in detail, the foregoing description is in all aspects illustrative and not restrictive. It is understood that numerous other modifications and variations can be devised without departing from the scope of the invention.

What is claimed is:

1. An electro-acoustical transducer, comprising:

a diaphragm of an elongated shape;

an edge for supporting the diaphragm such that the diaphragm is vibratable;

a first magnet of a parallelepiped shape which is (i) situated at a face of one principal surface of the diaphragm such that long sides of the first magnet are in parallel with long sides of the diaphragm, (ii) polarized in a short side direction of the diaphragm to form a first magnetic gap to a side of the one principal surface of the diaphragm, and (iii) polarized in a direction perpendicular to a vibration direction of the diaphragm;

a second magnet of a parallelepiped shape which is (i) situated next to the first magnet in the short side direction of the diaphragm such that long sides of the second magnet are in parallel with the long sides of the diaphragm, (ii) polarized toward a direction in a manner opposite to the first magnet so as to form a second magnetic gap to the side of the one principal surface of the diaphragm, and (iii) polarized in a direction perpendicular to the vibration direction of the diaphragm;

a first plate made from a ferromagnetic material and which is sandwiched between the first magnet and the second magnet without an air gap; and a first coil which is (i) wound to form an elongated ring shape, and (ii) situated on the diaphragm such that long sides of the first coil are in parallel with the long sides of the diaphragm and such that each of the long sides of the first coil is situated within a range of each of the first magnetic gap and the second magnetic gap, wherein a height of the first plate, a height of the first magnet, and a height of the second magnet are identical in the vibration direction of the diaphragm, wherein surfaces, which face the diaphragm, of the first magnet, the second magnet, and the first plate are located on a common plane, wherein the electro-acoustical transducer further comprises:

a second plate situated so as to be in contact with a pole face of the first magnet, the pole face being opposite to another pole face of the first magnet which is in contact with the first plate; and a third plate situated so as to be in contact with a pole face of the second magnet, the pole face being opposite to another pole face of the second magnet which is in contact with the first plate, wherein respective surfaces, which face the diaphragm, of the second plate and the third plate are located on a plane closer to the diaphragm than respective surfaces, which face the diaphragm, of the first magnet, the second magnet, and the first plate, wherein a cross section of the edge is convex toward another principal surface of the diaphragm, and wherein the second plate and the third plate are respectively situated such that the respective surfaces, which face the diaphragm, of the second plate and the third plate, face the edge.

2. The electro-acoustical transducer according to claim 1, wherein each of the long sides of the first coil are situated above at least one of surfaces, which face the diaphragm, of the first magnet, the second magnet, the first plate, the second plate, and the third plate.

3. The electro-acoustical transducer according to claim 1, further comprising a third magnet of a parallelepiped shape which is (i) situated at a face of the other principal surface of the diaphragm such that long sides of the third magnet are in parallel with the long sides of the diaphragm, and (ii) situated so as to be located above a position between the first magnet and the second magnet in the short side direction of the diaphragm, wherein the third magnet is polarized in the vibration direction of the diaphragm such that a polarity of a pole face of the third magnet facing another principal surface of the diaphragm is the same as a polarity of pole faces, which are in contact with the first plate, of the first magnet and the second magnet.

4. The electro-acoustical transducer according to claim 1, wherein a length of the diaphragm in the short side direction is one-half or less than a length of the diaphragm in a long side direction.

5. The electro-acoustical transducer according to claim 1, wherein a length of the first coil in a long side direction is 60% or more of a length of the diaphragm in a long side direction.

6. The electro-acoustical transducer according to claim 1, wherein the diaphragm and the first coil are molded in a unified manner.

7. The electro-acoustical transducer according to claim 1, wherein the first coil is situated such that respective central positions of winding widths of the long sides of the first coil correspond to respective central positions of widths of the first magnet and the second magnet in the short side direction of the diaphragm.

8. The electro-acoustical transducer according to claim 1, wherein the long sides of the first coil are situated at positions of nodal lines of a first resonant mode occurring on the diaphragm in the short side direction.

9. The electro-acoustical transducer according to claim 1, further comprising, a second coil which is (i) wound to form an elongated ring shape, and (ii) situated at an inner side of the first coil on the diaphragm such that long sides of the second coil are in parallel with the long sides of the diaphragm and such that each of the long sides of the second coil are located within the range of each of the first magnetic gap and the second magnetic gap, wherein the long sides of the first coil and the long sides of second coil are situated at positions to suppress a first resonant mode and a second resonant mode occurring on the diaphragm in the short side direction.

10. A portable terminal apparatus comprising:

the electro-acoustical transducer according to claim 1; and an equipment housing accommodating the electro-acoustical transducer.

11. A vehicle comprising:

the electro-acoustical transducer according to claim 1; and a vehicle body accommodating the electro-acoustical transducer.

12. An audio-visual apparatus comprising:

the electro-acoustical transducer according to claim 1; and an equipment housing accommodating the electro-acoustical transducer.

* * * * *